US010377603B2

(12) United States Patent
Sumioka

(10) Patent No.: US 10,377,603 B2
(45) Date of Patent: Aug. 13, 2019

(54) SHEET SUPPLYING APPARATUS AND PRINTING APPARATUS

(71) Applicant: CANON KABUSHIKI KAISHA, Tokyo (JP)

(72) Inventor: Masaki Sumioka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 680 days.

(21) Appl. No.: 14/939,018

(22) Filed: Nov. 12, 2015

(65) Prior Publication Data

US 2016/0137448 A1 May 19, 2016

(30) Foreign Application Priority Data

Nov. 19, 2014 (JP) ..... 2014-234761

(51) Int. Cl.

| | |
|---|---|
| ***B41J 15/04*** | (2006.01) |
| ***B65H 43/00*** | (2006.01) |
| ***B65H 43/02*** | (2006.01) |
| ***B65H 16/02*** | (2006.01) |
| ***B65H 16/10*** | (2006.01) |
| ***B65H 19/10*** | (2006.01) |

(52) U.S. Cl.

CPC ..... *B65H 43/02* (2013.01); *B41J 15/04* (2013.01); *B65H 16/028* (2013.01); *B65H 16/103* (2013.01); *B65H 19/105* (2013.01); *B65H 2301/41346* (2013.01); *B65H 2301/41376* (2013.01); *B65H 2404/512* (2013.01); *B65H 2801/36* (2013.01)

(58) Field of Classification Search

CPC ..... B41J 15/04; B65H 16/08; B65H 16/028; B65H 16/103; B65H 19/05; B65H 23/182; B65H 23/04; B65H 230/41643; B65H 2306/41376; B65H 2404/512; B65H 2801/36; B65H 19/105

See application file for complete search history.

(56) References Cited

U.S. PATENT DOCUMENTS

| | | | | |
|---|---|---|---|---|
| 2,053,022 A * | 9/1936 | Corswandt | ..... | B65H 23/08 242/566 |
| 4,552,316 A * | 11/1985 | Dropczynski | ..... | B65H 16/08 242/521 |
| 2007/0095968 A1* | 5/2007 | Kusel | ..... | B65H 16/08 242/541 |

(Continued)

FOREIGN PATENT DOCUMENTS

| | | | | |
|---|---|---|---|---|
| EP | 1088672 | * | 4/2001 | ..... B41J 11/0095 |
| EP | 2366647 | * | 9/2011 | ..... B65H 16/08 |

(Continued)

OTHER PUBLICATIONS

Copending, unpublished U.S. Appl. No. 14/939,115, to Ryo Kobayashi, dated Nov. 12, 2015.

*Primary Examiner* — Matthew G Marini
*Assistant Examiner* — Marissa Ferguson-Samreth
(74) *Attorney, Agent, or Firm* — Venable LLP

(57) ABSTRACT

A trailing portion of a sheet drawn out of a sheet roll is discharged with a simple configuration. In a case where a trailing portion of the sheet is drawn out of the sheet roll, a driven roller is brought into press-contact with a core of the sheet roll via the trailing portion, whereby the trailing portion is discharged by utilizing the rotation of the core of the sheet roll.

12 Claims, 19 Drawing Sheets

(56) References Cited

U.S. PATENT DOCUMENTS

| | | | | |
|---|---|---|---|---|
| 2015/0328906 | A1* | 11/2015 | Sumioka | B65H 16/08<br>242/564.5 |
| 2015/0328909 | A1* | 11/2015 | Takizawa | B41J 13/0009<br>347/104 |
| 2016/0136981 | A1* | 5/2016 | Suzuki | B41J 15/16<br>347/104 |

FOREIGN PATENT DOCUMENTS

| | | | | |
|---|---|---|---|---|
| JP | 11-011750 | A | 1/1999 | |
| JP | 2002-348011 | * | 12/2002 | B65H 26/08 |
| JP | 2002-348011 | A | 12/2002 | |
| JP | 2003-012205 | A | 1/2003 | |
| JP | 2013-116561 | A | 6/2013 | |

* cited by examiner

SHEET SUPPLYING APPARATUS AND PRINTING APPARATUS

BACKGROUND OF THE INVENTION

Field of the Invention

The present invention relates to a sheet supplying apparatus that draws a sheet from a sheet roll, in which a sheet is wound in a rolled manner, so as to supply the sheet, and a printing apparatus.

Description of the Related Art

A printing apparatus provided with a sheet supplying apparatus that draws a sheet out of a sheet roll so as to supply the sheet, a conveyance unit that conveys the supplied sheet in a predetermined conveyance direction, and a print unit that prints an image on the conveyed sheet has been known. In this printing apparatus, a trailing portion of the sheet drawn out of the sheet roll is discharged to the outside of the printing apparatus by the conveyance unit.

In a printing apparatus disclosed in Japanese Patent Laid-Open No. 2002-348011, a discharge roller positioned downstream of a print unit in a sheet conveyance direction discharges a trailing portion of a sheet in the sheet conveyance direction. Alternatively, in a printing apparatus disclosed in Japanese Patent Laid-Open No. 2003-12205, a supply roller positioned upstream of a print unit in a sheet conveyance direction is reversely rotated such that a trailing portion of a sheet is discharged in a direction reverse to the sheet conveyance direction.

However, as disclosed in Japanese Patent Laid-Open Nos. 2002-348011 and 2003-12205, providing the discharge roller or the supply roller for discharging the trailing portion of the sheet possibly induces increases in size, weight, and cost of a sheet supplying apparatus and a printing apparatus.

SUMMARY OF THE INVENTION

The present invention provides a sheet supplying apparatus that can discharge a trailing portion of a sheet drawn out of a sheet roll with a simple configuration, and a printing apparatus.

In the first aspect of the present invention, there is provided a sheet supplying apparatus that draws a sheet out of a sheet roll and supplies the sheet, the sheet supplying apparatus comprising:

a pressing unit having a roller configured to move according to a size of an outer diameter of the sheet roll, so as to be brought into press-contact with an outer periphery of the sheet roll, wherein in a case where all of the sheet is drawn out of the sheet roll, a trailing portion of the drawn sheet can be conveyed, while the trailing portion is held between a center portion of the sheet roll and the pressing unit, in a direction reverse to a direction in which the sheet is supplied.

In the second aspect of the present invention, there is provided a printing apparatus comprising:

a sheet supplying apparatus that draws a sheet out of a sheet roll and supplies the sheet, the sheet supplying apparatus including a pressing unit configured to move according to a size of an outer diameter of the sheet roll so as to be brought into press-contact with an outer periphery of the sheet roll, wherein in a case where all of the sheet is drawn out of the sheet roll, a trailing portion of the drawn sheet can be conveyed, while the trailing portion is held between a center portion of the sheet roll and the pressing unit, in a direction reverse to a direction in which the sheet is supplied; and a print unit that prints an image on the supplied sheet.

According to the present invention, in a case where the trailing portion of the sheet is drawn out of the sheet roll, the pressing unit is brought into press-contact with the center portion of the sheet roll via the trailing portion of the sheet, so that the trailing portion of the sheet can be discharged by utilizing the rotation of the center portion of the sheet roll. Therefore, it is unnecessary to individually provide a discharge roller or a supply roller for discharging the trailing portion of the sheet, thus achieving the miniaturization, light weight, and reduced cost of the sheet supplying apparatus and the printing apparatus.

Further features of the present invention will become apparent from the following description of exemplary embodiments (with reference to the attached drawings).

BRIEF DESCRIPTION OF THE DRAWINGS

FIG. 4A is a view illustrating the sheet supplying apparatus and FIG. 48 is an enlarged view showing an equalizing mechanism in the sheet supplying apparatus;

FIG. 5A is a side view showing the equalizing mechanism and FIG. 58 is a plan view showing the equalizing mechanism;

FIGS. 10A, 108, and 10C are views each illustrating the printing apparatus in another example during the discharging operation of the trailing portion of the sheet;

DESCRIPTION OF THE EMBODIMENTS

Embodiments of the present invention will be described below with reference to the attached drawings.

(First Embodiment)

FIGS. 1 to 8 are views illustrating a first embodiment of the present invention. In the present embodiment, the present invention is applied to an ink jet printing apparatus provided with a sheet supplying apparatus that supplies a sheet serving as a print medium and a print unit that prints an image on the sheet.

Figure 1:
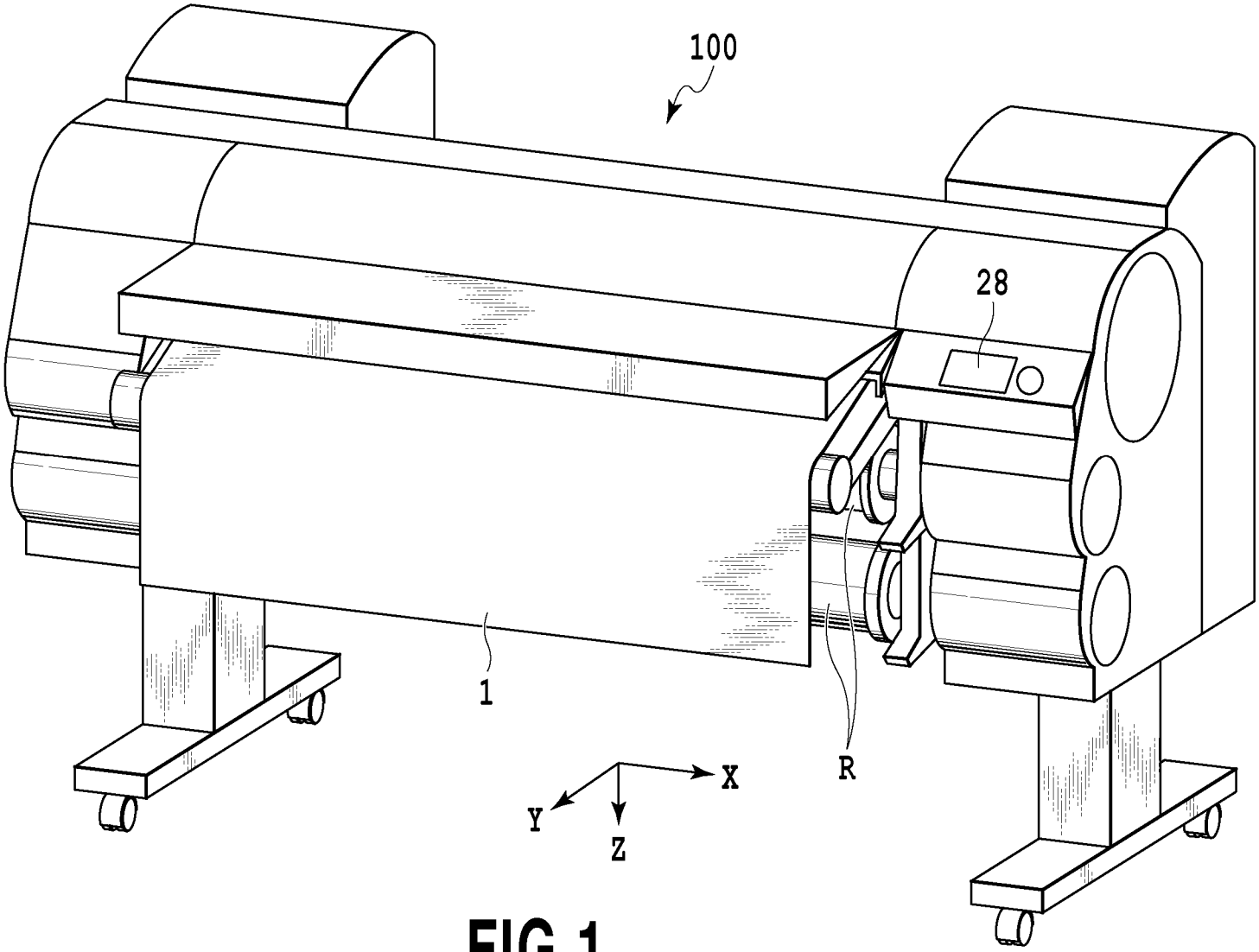
FIG. 1 is a perspective view showing a printing apparatus in a first embodiment of the present invention.

As shown in FIG. 1, two of sheet rolls R, around each of which a sheet 1 is wound in a roll-like manner, can be set in a printing apparatus 100. An image is printed on the sheet 1 that is selectively drawn out of either of the sheet rolls R. A user can input various kinds of commands with respect to the printing apparatus 100 via various kinds of switches provided on an operation panel 28 so as to designate the size of the sheet 1 or switch between on-line and off-line.

Figure 2:
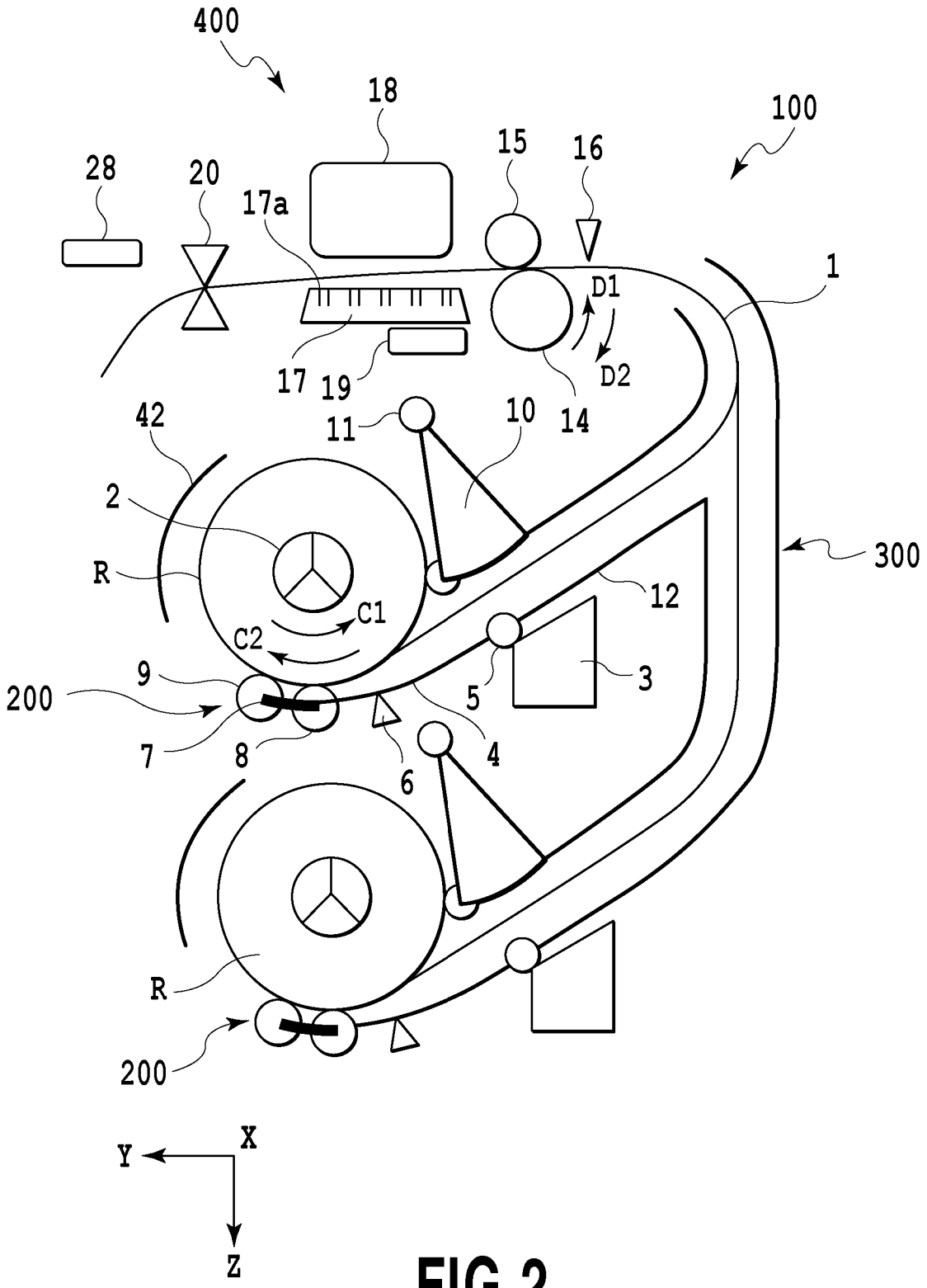
FIG. 2 is a view illustrating a sheet conveyance path in the printing apparatus.

FIG. 2 is a cross-sectional view schematically showing essential parts of the printing apparatus 100. Two sheet supplying apparatuses 200 are vertically arranged in a manner corresponding to the two sheet rolls R. The sheet 1 drawn out of the sheet roll R by the sheet supplying apparatus 200 is conveyed to a print unit 400 capable of printing an image by a sheet conveying unit (i.e., a conveying mechanism) 300. The print unit 400 allows ink to be ejected from an ink jet print head 18 so as to print an image on the sheet 1. The print head 18 ejects ink through an ejection port by using ejection energy generating element such as an electrothermal transducer (i.e., a heater) or a piezoelectric element. In the case of the use of the electrothermal transducer, its heat generation enables ink to be foamed, so that the resultant foaming energy enables ink to be ejected through the ejection port. The print system of the print head 18 is not limited to only an ink jet system. Moreover, the print system of the print unit 400 is not limited, and therefore, it may be, for example, of a serial scanning system or a full line system. In the case of the serial scanning system, a conveying operation of the sheet 1 and a scanning operation by the print head 18 in a direction transverse a conveyance direction of the sheet 1 are performed while an image is printed. In the case of the full line system, the sheet 1 is sequentially conveyed while an elongated print head 18 that extends in the direction transverse the conveyance direction of the sheet 1 prints an image.

A spool member 2 formed into a shaft-like shape is inserted into a hollow hole of the sheet roll R, and then, the spool member 2 is driven forward or reversely by a roll driving motor, described later. In this manner, the sheet roll R is held at the center portion thereof, to be thus rotated forward and reversely in directions indicated by arrows C1 and C2. The supplying apparatus 200 is provided with a drive unit 3, an arm member (i.e., a moving member) 4, an arm turning shaft 5, a first sheet sensor (i.e., a detecting unit) 6, an oscillating member 7, driven rollers (i.e., pressing units) 8 and 9, a separating flapper (i.e., an upper guide member) 10, and a flapper swing shaft 11, as described later.

A conveyance guide 12 guides the obverse and reverse of the sheet 1 drawn out of the supplying apparatus 200 while guiding the sheet 1 to the print unit 400. A conveyance roller 14 is rotated forward and reversely in directions indicated by arrows D1 and D2 by a conveyance roller driving motor, described later. A nip roller 15 can be rotated following the rotation of the conveyance roller 14, and furthermore, can be brought into or out of contact with the conveyance roller 14 by a nip roller separating motor, not shown. Moreover, the nip roller 15 can adjust nipping force. The conveyance roller 14 is rotated upon detection of the tip of the sheet 1 by a second sheet sensor 16. A conveyance speed of the sheet 1 by the conveyance roller 14 is set to be higher than the drawing speed of the sheet 1 according to the rotation of the sheet roll R, and thus, back tension can be applied to the sheet 1 that can be conveyed in the tensile state. Consequently, it is possible to prevent the sheet 1 from sagging, so as to suppress the generation of folds on the sheet 1 or a conveyance error.

A platen 17 at the print unit 400 adsorbs the reverse of the sheet 1 through suction holes 17*a* under vacuum generated by a suction fan 19. In this manner, the position of the sheet 1 is restricted along the platen 17, so that the print head 18 can print an image with high accuracy. A cutter 20 can cut the sheet 1 having the image printed thereon. A cover 42 for the sheet roll R prevents the sheet 1 having the image printed thereon from returning to the supplying apparatus 200. The operation of the printing apparatus 100 is controlled by a CPU, described later.

Figure 3A:
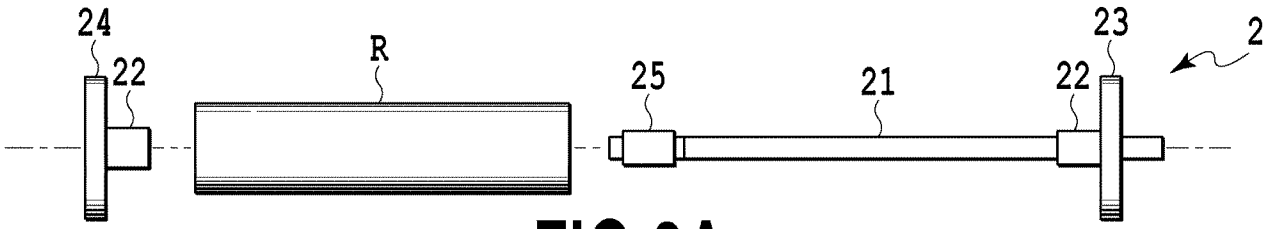
FIG. 3A is an exploded view showing a spool in a sheet supplying apparatus.
Figure 3B:
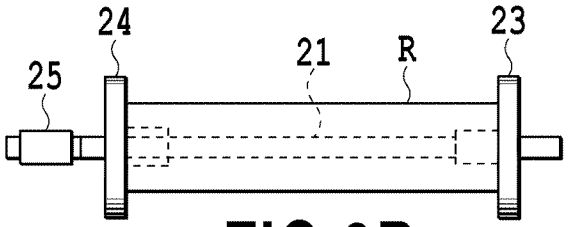
FIG. 3B is a front view showing the spool.
Figure 3C:
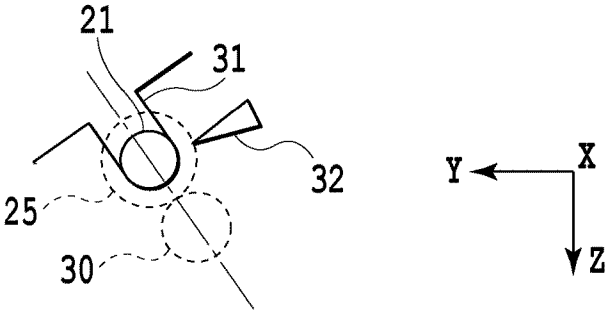
FIG. 3C is a view illustrating a set state of the spool.

FIGS. 3A, 3B, and 3C are views illustrating procedures for setting the sheet roll R at the supplying apparatus 200 by the use of the spool member 2. The spool member 2 includes a spool shaft 21, friction members 22, a spool flange 23 on a reference side, a spool flange 24 on a non-reference side, and a spool gear 25. The spool flange on the reference side is attached to one end of the spool shaft 21 whereas the spool gear 25 for rotating the spool shaft 21 is fixed to the other end of the spool shaft 21. The friction members 22 are provided inside of the spool flange 23 on the reference side and the spool flange 24 on the non-reference side, respectively.

In setting the spool member 2 at the sheet roll R, first, the spool flange 24 on the non-reference side fitted to the spool shaft 21 is detached, and then, the spool shaft 21 is inserted into the hollow hole of the sheet roll R. Since the outer diameter of the spool shaft 21 is smaller than the inner diameter of the hollow hole of the sheet roll R, a clearance is defined therebetween. Therefore, a user can insert the spool shaft 21 into the hollow hole by a slight force. At the time when the right end of the sheet roll R in FIG. 3A is brought into contact with the spool flange 23 on the reference side, the friction member 22 inside of the spool flange 23 on the reference side is inserted into the hollow hole of the sheet roll R. In this manner, the spool flange 23 on the reference side is fixed to the sheet roll R. Thereafter, the spool flange 24 on the non-reference side is fitted to the spool shaft 21, and then, the friction member 22 inside of the spool flange 24 on the non-reference side is inserted into the hollow hole of the sheet roll R. As a consequence, the spool flange 24 on the non-reference side is fixed to the sheet roll R.

In this manner, the sheet roll R is fitted to the spool member 2, as shown in FIG. 3D. Thereafter, as shown in FIG. 3C, both ends of the spool member 2 are inserted into spool holders 31 at the supplying apparatus 200, thus completing the setting of the sheet roll R.

The spool holders 31 are disposed at positions corresponding to both ends of the spool shaft 21. The inner surface of each of the spool holders 31 is formed into a U shape. The end of the spool shaft 21 can be inserted through an opening formed at the spool holder 31. In a state in which the spool member 2 is inserted into the spool holders 31, the spool gear 25 is connected to a roll driving motor, described later, via a drive gear 30 on the side of the supplying apparatus 200. The roll driving motor drives the sheet roll R together with the spool member 2 forward and reversely, thereby supplying and winding the sheet 1. A roll sensor 32 is adapted to detect the sheet roll R.

Figure 4A:
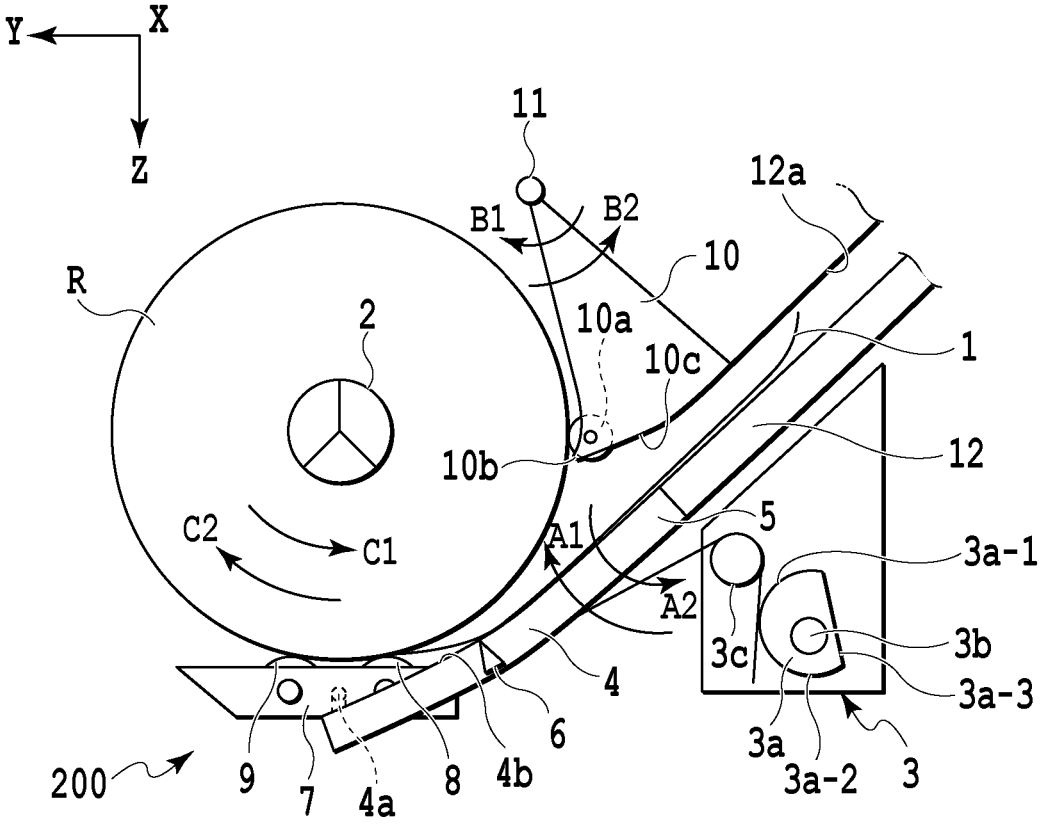

FIGS. 4A, 48, 5A, and 5B are views illustrating the supplying apparatus 200. The outer diameter of the sheet roll R in FIG. 4A is relatively large.

The arm member (i.e., the moving member) 4 is attached to the conveyance guide 12 via the turning shaft 5 in a manner turnable in directions indicated by arrows A1 and A2. At the upper portion of the arm member 4 is formed a guide 4*b* (i.e., a lower side guide member) for guiding the lower surface of the sheet 1 drawn out of the sheet roll R. A torsion coil spring 3*c* for pressing the arm member 4 in the direction indicated by the arrow A1 is interposed between the arm member 4 and a rotary cam 3*a* of the drive unit 3. The rotary cam 3*a* is rotated by a pressurizing/driving motor 34, described later, thereby varying force of the torsion coil spring 3*c* for pressing the arm member 4 in the direction indicated by the arrow A1. In a case where a relatively large diameter portion 3*a*-1 of the rotary cam 3*a* is brought into contact with the torsion coil spring 3*c*, the pressing force becomes large to generate "pressing force for strong nip," described later. In contrast, in a case where a relatively small diameter portion 3*a*-2 of the rotary cam 3*a* is brought into contact with the torsion coil spring 3*c*, the pressing force becomes small to generate "pressing force for weak nip," described later. Furthermore, in a case where a flat portion 3*a*-3 of the rotary cam 3*a* is brought into contact with the torsion coil spring 3*c*, the pressing force for pressing the arm member 4 in the direction indicated by the arrow A1 is released, so that first and second driven rollers (rotators), described later, are separated from the sheet roll R.

The supplying apparatus 200 is configured in such a manner as to be freely switched among three stages: the state in which the arm member 4 is pressed by a predetermined "pressing force for weak nip"; the state in which the arm member 4 is pressed by a predetermined "pressing force for strong nip"; and the state in which the pressing force for the arm member 4 is released.

The oscillating member 7 is oscillatably attached to the arm member 4. First and second driven rollers 8 and 9 (i.e., a pressing unit) shifted in the circumferential direction of the sheet roll R are rotatably attached to the oscillating member 7. The first and second driven rollers 8 and 9 are brought into press-contact with the outer periphery of the sheet roll R from below with respect to a gravity direction by the pressing force against the arm member 4 in the direction indicated by the arrow A1. In other words, the first and second driven rollers 8 and 9 are brought into press-contact with the outer periphery of the sheet roll R from below the center axis in the horizontal direction of the sheet roll R with respect to the gravity direction. The press-contact force is varied according to the pressing force for pressing the arm member 4 in the direction indicated by the arrow A1. As a consequence, the drive unit 3 functions as a pressing mechanism for pressing the arm member 4. The drive unit 3 also functions as a moving mechanism for moving the arm member 4 in such a manner as to separate the first and second driven rollers 8 and 9 from the outer periphery of the sheet roll R.

Figure 4B:
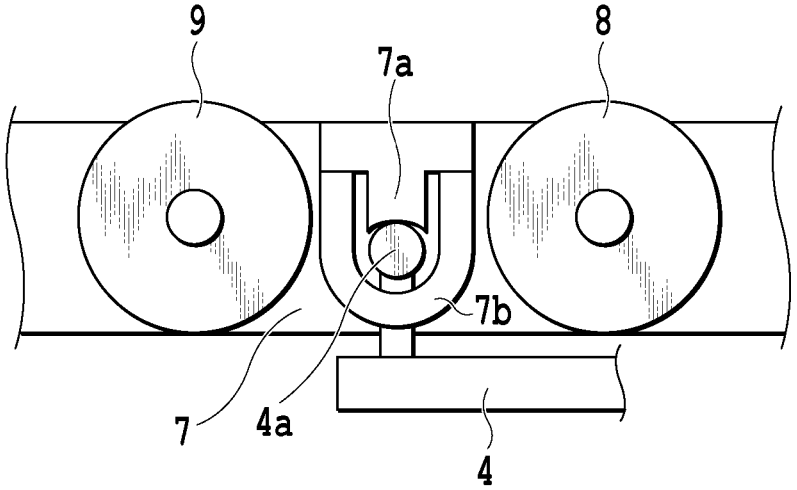
Figure 5A:
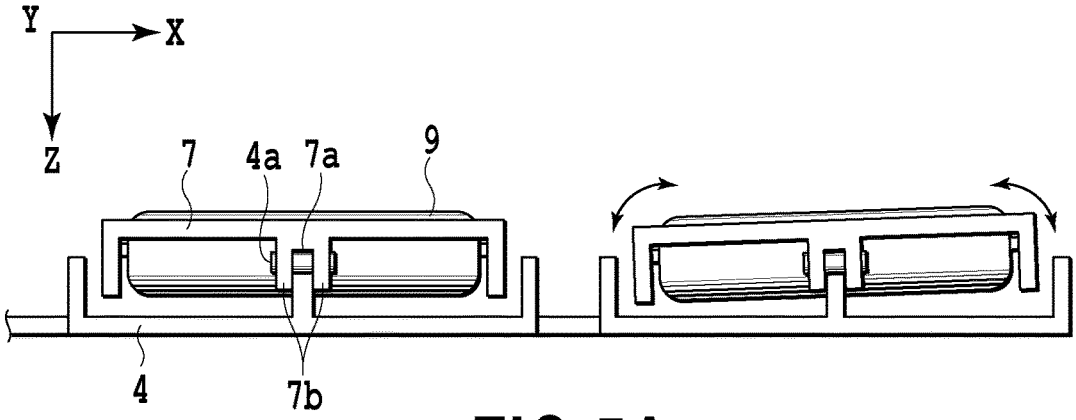
Figure 5B:
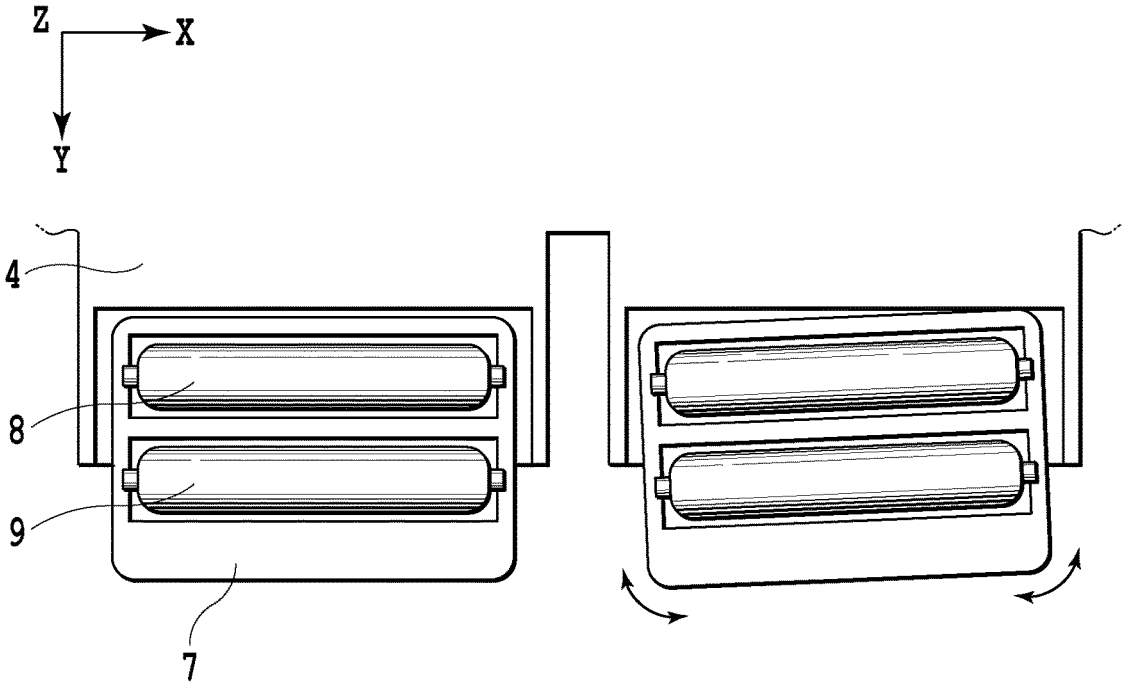

As shown in FIGS. 5A and 5B, the plurality of oscillating members 7 are attached to the arm member 4 in such a manner as to be arranged in a widthwise direction (i.e., an X-axial direction) of the sheet roll R. As shown in FIGS. 4D and 5A, the oscillating member 7 includes a shaft receiver 7*a* and shaft stoppers 7*b* that receive a rotary shaft 4*a* of the arm member 4 with a predetermined play. The shaft receiver 7*a* is brought into contact with the upper portion of the rotary shaft 4*a*. In contrast, the shaft stoppers 7*b* are positioned on both sides of the rotary shaft 4*a*, as shown in FIG. 5A, to thus face the lower portion and the front and rear portions (i.e., right and left portions in FIG. 4D) of the rotary shaft 4*a* with predetermined clearances. In this manner, the shaft stopper 7*b* restricts the range of the play of the rotary shaft 4*a*, and furthermore, stops the slippage of the rotary shaft 4*a*. In a case where the rotary shaft 4*a* is received between the shaft receiver 7*a* and the shaft stoppers 7*b*, at least one of the shaft stoppers 7*b* is temporarily elastically deformed such that an interval between the right and left shaft stoppers 7*b* in FIG. 5A is enlarged laterally in FIG. 5A. That is to say, the rotary shaft 4*a* is received through between the shaft stoppers 7*b* enlarged in the lateral direction. After the rotary shaft 4*a* is received in the above-described manner, the shaft stoppers 7*b* are elastically restored, thereby stopping the rotary shaft 4*a* from slipping, as shown in FIGS. 4B and 5A. The shaft stopper 7*b* may be made of an elastically deformable resin material.

The shaft receiver 7*a* is disposed at the gravity position of the oscillating member 7, and thus, is supported by the rotary shaft 4*a* in such a manner that the oscillating member 7 takes a stable posture in each of X-, Y-, and Z-axial directions. Specifically, like the left oscillating member 7 in FIGS. 5A and 5B, the oscillating member 7 is supported at its stable posture in each of the X-, Y-, and Z-axial directions. Moreover, since the rotary shaft 4*a* is received with play, the oscillating member 7 is equalized along the outer periphery of the sheet roll R by the pressing force in the direction indicated by the arrow A1 against the arm member 4, like the right oscillating member 7 in FIGS. 5A and 5B. This configuration (i.e., an equalizing mechanism) allows the variation of the press-contact posture of the first and second driven rollers 8 and 9 with respect to the outer periphery of the sheet roll R. Consequently, a contact area in which the sheet 1 and the first and second driven rollers 8 and 9 are brought into contact with each other is always kept to be the largest, and furthermore, the pressing force with respect to the sheet 1 is equalized, thus suppressing variations of the conveyance force for the sheet 1. The first and second driven rollers 8 and 9 are brought into press-contact with the outer periphery of the sheet roll R, thus suppressing the generation of sag on the sheet 1 and thereby increasing its conveyance force. The first driven roller 8 mainly contributes to an increase in conveyance force for the sheet 1; in contrast, the second driven roller 9 mainly contributes to suppression of the generation of sag on the sheet 1.

The rotary shaft 4*a* has a circular cross section and extends in the X-axial direction. The shaft receiver 7*a* has a groove having U-shaped cross section and extends in the X-axial direction. The upper portion of the former rotary shaft 4*a* is stably fitted to the groove in the latter, so that the oscillating member 7 takes a stable posture, like the left oscillating member 7 shown in FIGS. 5A and 5B. Force for restoring the stable posture acts on the oscillating member 7. The above-described equalizing mechanism is not limited to the configuration in this embodiment. Any equalizing mechanisms may be used as long as variations in press-contact posture of the first and second driven rollers 8 and 9 with respect to the outer periphery of the sheet roll R are allowed.

Although the equalizing mechanism is disposed at a connecting portion between the oscillating member 7 and the arm member 4 in the present embodiment, an equalizing mechanism may be disposed at a connecting portion between the arm member 4 and the conveyance guide 12. Moreover, the plurality of oscillating members 7 are arranged at intervals in the widthwise direction of the sheet 1 in the present embodiment. In a case where the position of the spool flange 24 on the non-reference side with reference to the spool flange 23 on the reference side is varied according to the width of the sheet 1, the spool flange 24 on the non-reference side may be located between the adjacent oscillating members 7. In this manner, it is possible to avoid any interference between the oscillating member 7 and the spool flange 24 on the non-reference side.

To the main body of the printing apparatus 100 (i.e., a printer body) is swingably attached with the separating flapper 10 positioned upward of the arm member 4 on the swing shaft 11 in directions indicated by arrows D1 and B2. The separating flapper 10 is configured such that the sheet roll R is slightly pressed by its own weight. In a case where the sheet roll R need be more strongly pressed, an urging force by an urging member such as a spring may be used. A driven roller 10*a* is rotatably provided at a contact portion between the separating flapper 10 and the sheet roll R so as to suppress an influence on the sheet 1 by the pressing force. Moreover, a separator 10*b* at the tip of the separating flapper 10 is formed in such a manner as to extend up to a position as close to the surface of the sheet roll R as possible in order to facilitate the separation of the tip of the sheet from the sheet roll R.

The sheet 1 is drawn out of the sheet roll R through above the driven rollers 8 and 9, the lower surface of the sheet 1 is guided by the guide 4*b* at the upper portion of the arm member 4, and then, the sheet 1 is supplied through a supply path formed between the separating flapper 10 and the arm member 4. In this manner, the driven rollers 8 and 9 are brought into press-contact with the outer periphery of the sheet roll R from below, and then, the lower surface of the sheet 1 drawn through above the driven rollers 8 and 9 is guided by the guide 4*b*. Consequently, the sheet 1 can be smoothly supplied by utilizing its own weight. Additionally, the driven rollers 8 and 9 and the guide 4*b* are moved according to the outer diameter of the sheet roll R, so that the sheet 1 can be securely drawn out of the sheet roll R to be conveyed irrespectively of the size of the outer diameter of the sheet roll R. The guide 4*b* is adapted to guide the lower surface of a trailing portion of the sheet in a case where the trailing portion of the sheet is discharged, as described later.

The sheet 1 drawn out of the sheet roll R passes under a lower surface 10*c* of the separating flapper 10, and then, passes under a lower surface 12*a* of the conveyance guide 12. The lower surface 12*a* of the conveyance guide 12 is formed into a shape in conformity with a virtual circle on the swing shaft 11, so that a supply path without any step between the lower surface 10*c* and the lower surface 12*a* can be formed irrespective of the swing position of the separating flapper 10 in the directions indicated by the arrows 81 and 82. In this manner, the tip of the sheet 1 cannot be stuck on the supply path. The lower surface 10*c* of the separating flapper 10 is formed into a curved shape in conformity with the virtual circle on the swing shaft 11.

It is desirable that the first sheet sensor 6 provided on the arm member 4 should be located at a position slightly shifted downstream in the conveyance direction of the sheet 1 from the nip position between the sheet roll R and the driven roller 8. In the present embodiment, the two supplying apparatuses 200 are provided in a vertical direction. Therefore, the state in which the sheet 1 is supplied from one of the supplying apparatuses 200 can be switched to the state in which the sheet 1 is supplied from the other supplying apparatus 200. In this case, one of the supplying apparatuses 200 rewinds the sheet 1, which has been supplied so far, around the sheet roll R, and then, retracts the tip of the sheet 1 up to a position at which the sheet sensor 6 detects the tip of the sheet 1. In a case where the sheet sensor 6 is largely shifted downstream in the conveyance direction more than the present embodiment, the tip of the sheet 1 suspends into a clearance defined between the driven roller 8 and the arm member 4 by its own weight, thereby inducing an inconvenience of an adverse influence on the nip state of the sheet 1. Like the present embodiment, the sheet sensor 6 is disposed near the nip position between the sheet roll R and the driven roller 8, thus suppressing the generation of suspension by its own weight, so as to hardly mark a nip scar on the sheet 1.

Figure 6:
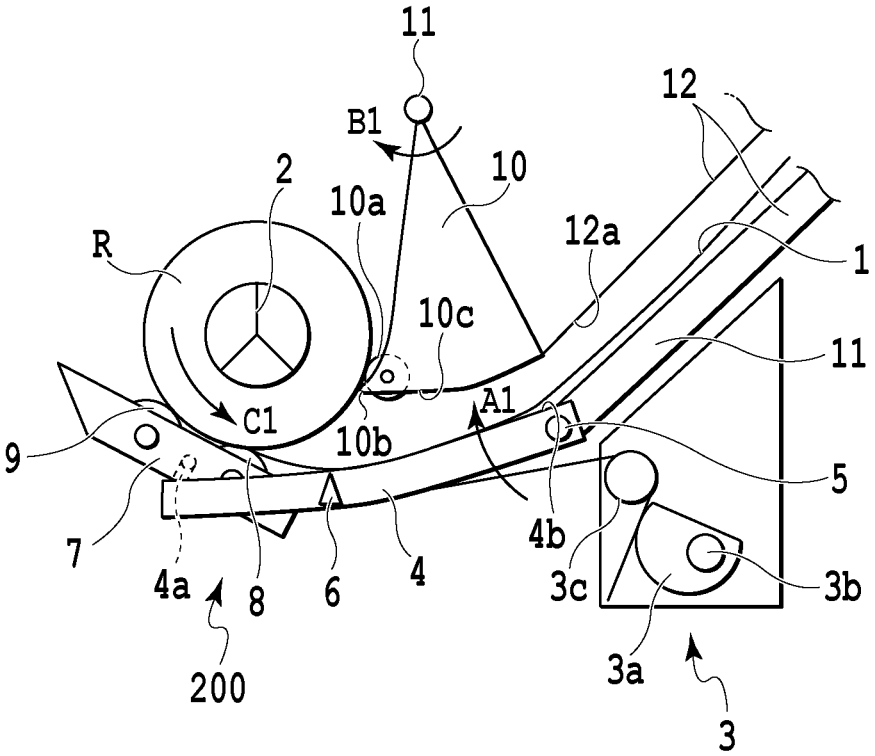
FIG. 6 is a view illustrating the sheet supplying apparatus in the case of a small outer diameter of a roll.

FIG. 6 is a view illustrating the supplying apparatus 200 in the case of a relatively small outer diameter of the sheet roll R.

Since the arm member 4 is pressed all the time in the direction indicated by the arrow A1 by the torsion coil spring 3*c*, the arm member 4 is turned in the direction indicated by the arrow A1 according to a decrease in outer diameter of the sheet roll R. Since the separating flapper 10 also is pressed all the time in the direction indicated by the arrow B1, the separating flapper 10 is swung in the direction indicated by the arrow B1 according to a decrease in outer diameter of the sheet roll R. Consequently, the separating flapper 10 forms the supply path between the conveyance guide 12 and the same even in a case where the outer diameter of the sheet roll R is decreased, thus guiding the upper surface of the sheet 1 by the lower surface 10*c*. In this manner, the arm member 4 is turned and the separating flapper 10 is swung according to a change in outer diameter of the sheet roll R, so that a substantially constant supply path is formed between the arm member 4 and the separating flapper 10 irrespective of the size of the outer diameter of the roll. As a consequence, even a sheet 1 having a low rigidity can be securely supplied without any buckling. Moreover, the lower surface 10*c* of the separating flapper 10 comes to form a discharge path, in which the trailing portion of the sheet is inserted, between the lower surface 10*c* and the guide 4*b* of the arm member 4 in a case where the trailing portion of the sheet is discharged, as described later.

Figure 7:
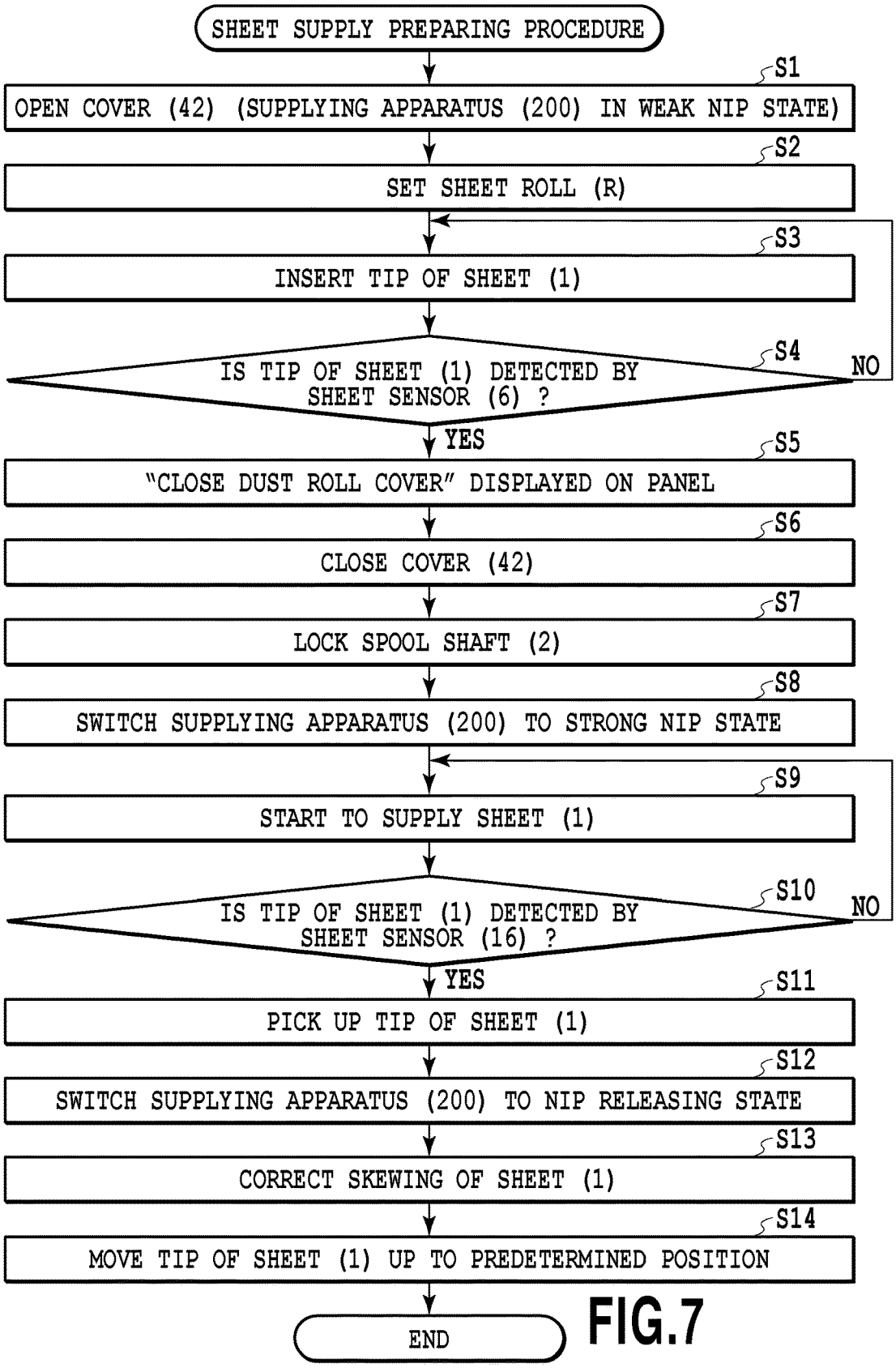
FIG. 7 is a flowchart illustrating a sheet supply preparing operation.

FIG. 7 is a flowchart illustrating sheet supply preparing procedures after setting of the sheet roll R.

First of all, the cover (i.e., a dust roll cover) 42 (see FIG. 2) of the sheet roll R is opened (step S1). At this time, the supplying apparatus 200 stands by in the state in which the arm member 4 is pressed by the "pressing force for weak nip" in the direction indicated by the arrow A1 (a weak nip state). Next, the spool member 2 is attached to the sheet roll R, as shown in FIGS. 3A and 3B, and then, the sheet roll R is set at the supplying apparatus 200 (step S2), as shown in FIG. 3C. The roll sensor 32 detects the setting of the sheet roll R.

A user sets the sheet roll R in this manner, and then, manually rotates the sheet roll R in the direction indicated by the arrow C2 to eliminate the sag of the sheet 1. Thereafter, the user manually rotates at least either one of the spool flanges 23 and 24 in the direction indicated by the arrow C1. In this manner, the tip of the sheet 1 is inserted into a sheet supply port defined between the arm member 4 and the separating flapper 10 (step S3). Upon the detection of the tip of the sheet 1 by the first sheet sensor 6, a CPU, described later, in the printing apparatus 100 displays a message of "close dust roll cover" on a display of the operation panel 28 (see FIG. 1) (steps S4 and S5). In a case where the user closes the cover 42 in response to the message (step S6), the CPU locks the spool shaft 21 by a lock mechanism, not shown, in such a manner as to prevent the spool shaft 21 from floating from the spool holder 31 (step S7). Thereafter, the CPU switches the supplying apparatus 200 from the weak nip state to a state in which the supplying apparatus 200 presses the arm member 4 in the direction indicated by the arrow A1 by the "pressing force for strong nip" (a strong nip state) (step S8).

After that, the CPU rotates the sheet roll R in the direction indicated by the arrow C1 by the roll driving motor, described later, thereby starting the supply of the sheet 1 (step S9). Upon the detection of the tip of the sheet 1 by the second sheet sensor 16 (step S10), the CPU rotates the conveyance roller 14 forward in the direction indicated by the arrow D1, thereby picking up the tip of the sheet 1 (step S11). Upon completion of the picking-up, the CPU releases the pressing force for pressing the arm member 4 at the supplying apparatus 200 in the direction indicated by the arrow A1, thus separating the first and second driven rollers 8 and 9 from the sheet roll R (a nip releasing state) (step S12).

Thereafter, the CPU detects the skewing of the sheet 1 conveyed inside of the sheet conveying apparatus 300. Specifically, the sheet 1 is conveyed inside of the sheet conveying apparatus 300 by a predetermined amount, and a sensor or the like provided for the sheet conveying apparatus 300 detects the skewing amount generated at this time. In a case where the skewing amount is larger than an allowable amount, the sheet 1 is repeatedly fed forward and backward according to the forward and reverse rotation of the conveyance roller 14 and sheet roll R. This operation corrects the skewing of the sheet 1 (step S13). In this manner, in correcting the skewing of the sheet 1 and printing an image on the sheet 1, the supplying apparatus 200 is released from the nip, thereby avoiding any adverse influence on the correction accuracy of the skewing of the sheet 1 and the print accuracy of an image by the driven rollers 8 and 9. And then, the CPU moves the tip of the sheet 1 up to a standby position (i.e., a predetermined position) at the print unit 400 inside by the sheet conveying unit 300 (step S14) before the start of a printing operation. In this manner, the supply preparation of the sheet 1 is completed. Thereafter, the sheet 1 is drawn out of the sheet roll R according to the rotation of the sheet roll R, to be thus conveyed to the print unit 400 by the sheet conveying unit 300.

Figure 8:
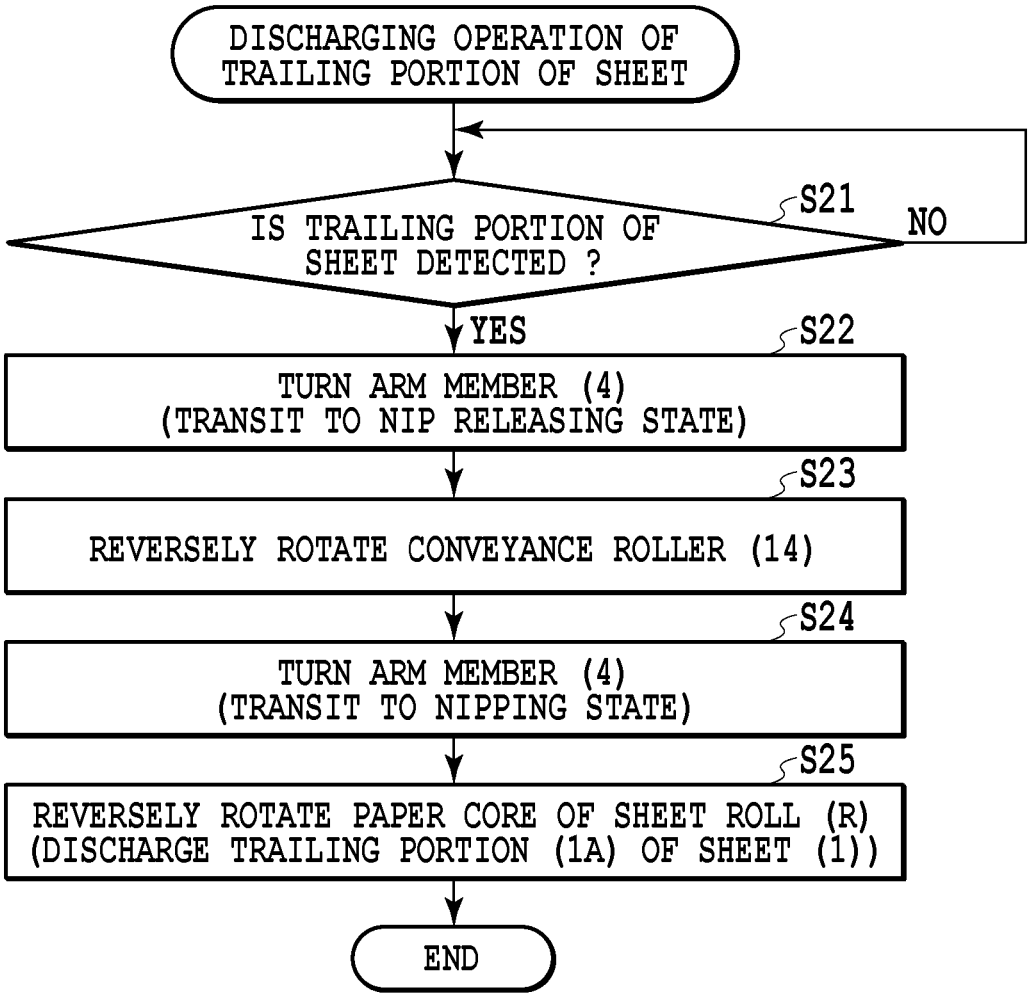
FIG. 8 is a flowchart illustrating a discharging operation of a trailing portion of a sheet.

FIG. 8 is a flowchart illustrating a basic discharging operation after the trailing portion of the sheet 1 is drawn out of the sheet roll R until the trailing portion is discharged. FIGS. 9A, 9B, 9C, and 9D illustrate the printing apparatus at the middle stages of the discharging operation. This discharging operation is controlled by the CPU, described later, in the printing apparatus 100.

Figure 9A:
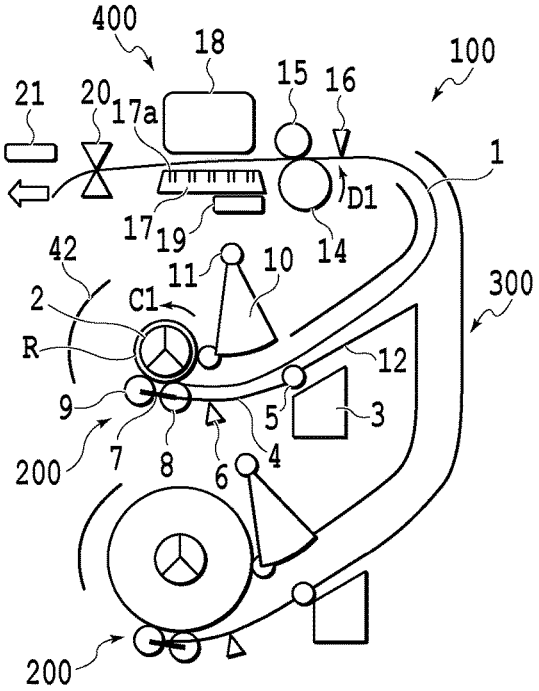
FIGS. 9A, 9B, 9C, and 9D are views each illustrating the printing apparatus in one example during the discharging operation of the trailing portion of the sheet.
Figure 9B:
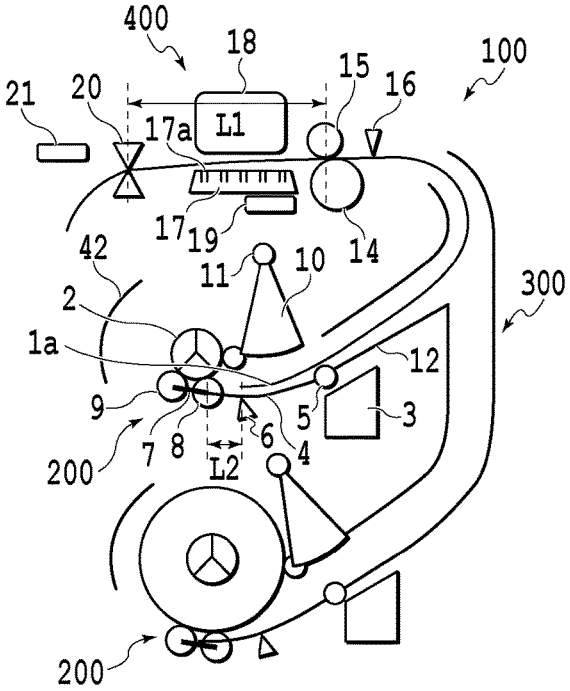

As the printing operation with respect to the sheet 1 supplied from the supplying apparatus 200 proceeds, the residue of the sheet 1 at the sheet roll R becomes smaller, as shown in FIG. 9A. Thereafter, as the printing operation proceeds, the trailing portion 1*a* of the sheet 1 comes off from the core (such as a paper core) of the sheet roll R, around which the sheet 1 is wound, as shown in FIG. 9B. And then, the first sheet sensor 6 detects the trailing portion (step S21). A distance between the cut position of the sheet 1 by the cutter 20 and the nip portion between the conveyance roller 14 and the nip roller is denoted by L1. Furthermore, a distance between a position detected by the first sheet sensor 6 and the contact position between the core (hereinafter referred to as the "paper core") of the sheet roll R and the first driven roller 8 is denoted by L2. These distances L1 and L2 have the relationship of L1>L2. As described later, in discharging the trailing portion 1*a* of the sheet 1 from the supplying apparatus 200, the trailing portion 1*a* can be nipped at the nip portion between the conveyance roller 14 and the nip roller 15 or between the paper core of the sheet roll R and the first driven roller 8.

Figure 9C:
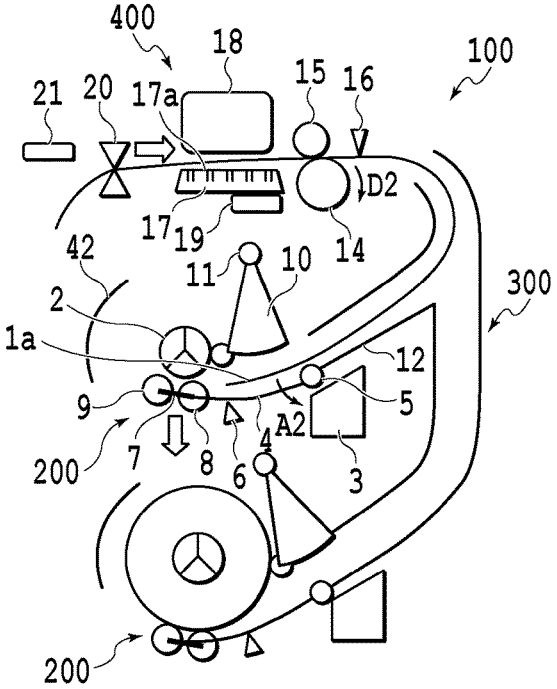

Thereafter, as shown in FIG. 9C, the drive unit 3 turns the arm member 4 in the direction indicated by the arrow A2, so that the first and second driven rollers 8 and 9 are brought into the nip releasing state in separation from the paper core of the sheet roll R (step S22). And then, the conveyance roller 14 is reversely rotated in the direction indicated by the arrow D2 (step S23), so that the trailing portion 1*a* is conveyed in the direction reverse to the conveyance direction of the sheet 1. At this time, the driven roller 10*a* of the separating flapper 10 is brought into contact with the paper core, and therefore, the intrusion of the trailing portion 1*a* upward of the paper core can be suppressed even in the case of strong curl of the trailing portion 1*a*. Moreover, the friction coefficient of the surface of the paper core is lower than that of the surface of a general roller provided on the conveyance path for the sheet 1, and therefore, the trailing portion 1*a* is likely to slip in contact with the surface of the paper core. In a case where the trailing portion 1*a* is conveyed in the direction reverse to the conveyance direction of the sheet 1, the trailing portion 1*a* is likely to be inserted between the paper core and the first and second driven rollers 8 and 9 since the supplying apparatus 200 is in the nip releasing state.

Figure 9D:
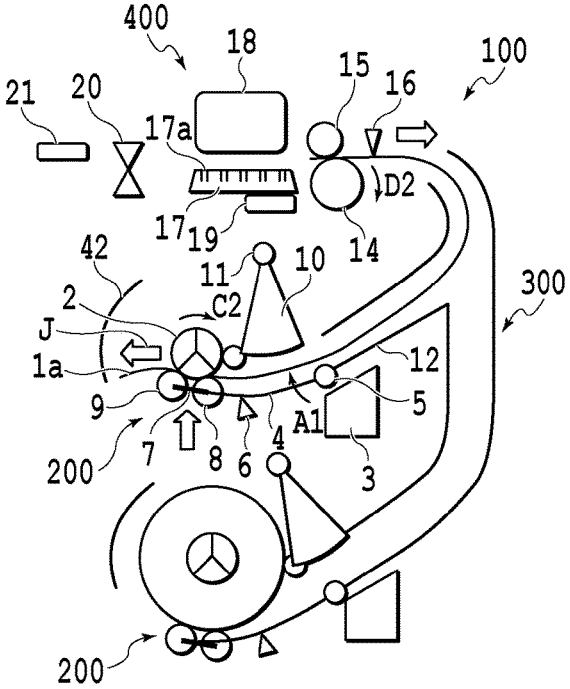

Thereafter, as shown in FIG. 9D, in a case where the trailing portion 1*a* reaches between the paper core and the driven rollers 8 and 9, the drive unit 3 turns the arm member 4 in the direction indicated by the arrow A1, so that the driven rollers 8 and 9 are brought into press-contact with the paper core in the nipping state (step S24). After that, the paper core of the sheet roll R is reversely rotated in the direction indicated by the arrow C2 together with the spool member 2, so that the supplying apparatus 200 discharges the trailing portion 1*a* in a direction indicated by an arrow J reversely to the supply direction of the sheet 1 (step S25). A space at which the set roll sheet 1 is located is defined at a position upstream of the paper core in the supply direction of the sheet 1. The space is open in a case where the trailing portion 1*a* is drawn, as shown in FIG. 9D. Thus, the trailing portion 1*a* can be smoothly discharged into the open space.

In this embodiment, the cover 42 is provided upstream of the open space in the supply direction of the sheet 1. The cover 42 is adapted to prevent any contact of a user or the like with the sheet roll R during a normal operation, and furthermore, to avoid any eventuality in which the sheet 1 having an image printed thereon erroneously intrudes into the supplying apparatus 200. The trailing portion 1*a* discharged upstream of the paper core in the supply direction of the sheet 1 may be wound around the paper core again inside of the cover 42 by utilizing its own curl, or may be discharged downward through an opening formed under the cover 42. In a case where the first sheet sensor 6 detects an upstream end of the trailing portion 1*a* discharged in the above-described manner in a discharge direction (i.e., a downstream end in the supply direction), the drive unit 3 may turn the arm member 4 in the direction indicated by the arrow A2, so as to separate the driven rollers 8 and 9 from the paper core.

The driven rollers 8 and 9 have both of the functions of supplying and discharging the sheet 1, thus simplifying and miniaturizing the configurations of the supplying apparatus 200 and the printing apparatus 100 so as to reduce their costs.

FIGS. 8, 9A, 9B, 9C, and 9D show the basic discharging operation at the time of the detection of the end of the sheet 1 by the first sheet sensor 6 during the printing operation.

Figure 10A:
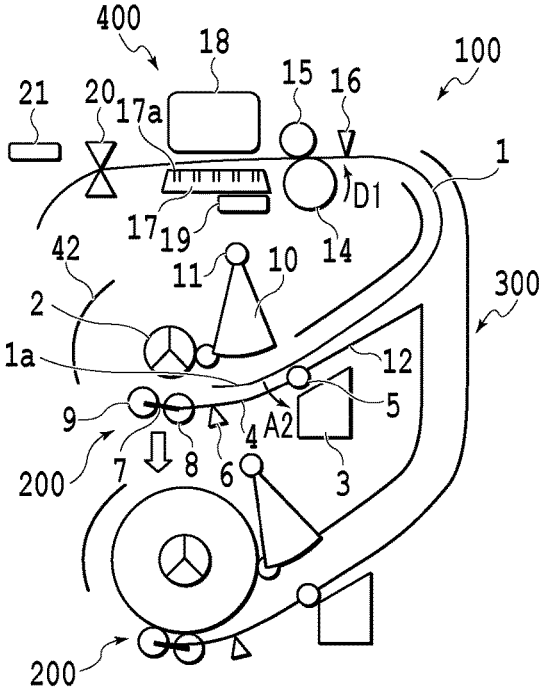
Figure 10B:
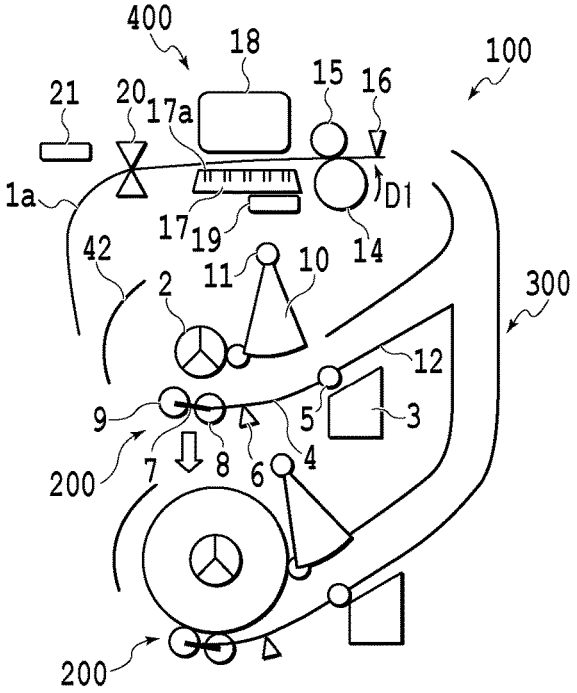
Figure 10C:
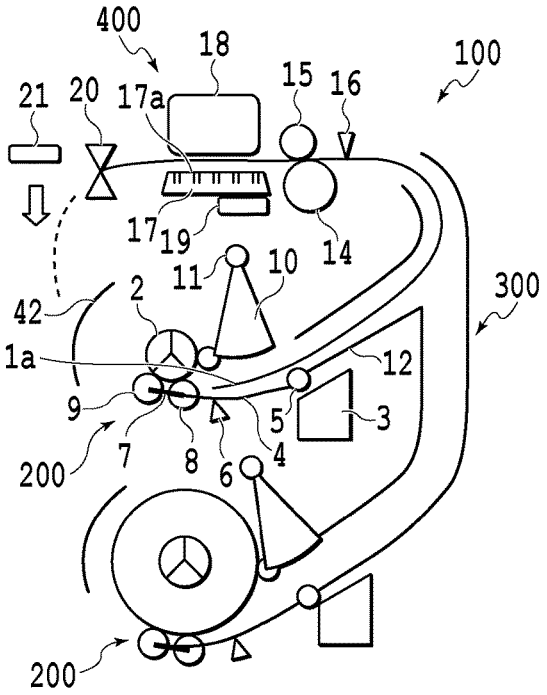

Contrary to this basic discharging operation, the sheet 1 may be discharged in the conveyance direction of the sheet 1 according to the type of sheet 1 and the length of the trailing portion 1*a*, as shown in FIGS. 10A, 108, and 10C.

Specifically, after the first sheet sensor 6 detects the end of the sheet 1, as shown in FIG. 10A, the conveyance roller 14 conveys the trailing portion 1*a* in the conveyance direction of the sheet 1, as shown in FIG. 10D, and then, the trailing portion 1*a* is discharged through a discharge port, not shown. The length of a part of the trailing portion 1*a* that has been already discharged through the discharge port, not shown, is sufficiently greater than the length of a part of the trailing portion 1*a* between the discharge port and the nip portion between the conveyance roller 14 and the nip roller 15 at the time when the end of the trailing portion 1*a* passes the conveyance roller 14, as shown in FIG. 10B. Therefore, after the end of the trailing portion 1*a* passes the conveyance roller 14, the trailing portion 1*a* is discharged through the discharge port by its own weight. In the present embodiment, at the time when the end of the trailing portion 1*a* is detected by the first sheet sensor 6, the arm member 4 is turned by the drive unit 3 in the direction indicated by an arrow A2, so that the first and second driven rollers 8 and 9 are released from the nipping state in separation from the paper core of the sheet roll R.

Moreover, in the basic discharging operation shown in FIGS. 8, 9A, 9D, 9C, and 9D, first and second operations, described below, may be combined according to the type of sheet 1 and the length of the trailing portion 1*a*.

In the first operation, first, as shown in FIG. 9B, in a case where the first sheet sensor 6 detects the end of the sheet 1 during the printing operation, the printing operation is stopped. After a lapse of a predetermined time, the trailing portion 1*a* is discharged in the direction indicated by the arrow J reverse to the supply direction of the sheet 1, as shown in FIGS. 9C and 9D. In this manner, since the trailing portion 1*a* is discharged after a lapse of a predetermined time, ink that has been applied onto the sheet 1 from the print head 18 can be sufficiently dried, thereby suppressing the transfer of the ink to the conveyance roller 14, the nip roller 15, and the driven rollers 8 and 9. The ink drying ease depends upon the type of sheet 1, and therefore, it is preferable to set a time (a drying time) required for drying the ink according to the type of sheet 1.

In the second operation, as shown in FIG. 10C, the printing operation is stopped in a case where the first sheet sensor 6 detects the end of the sheet 1 during the printing operation, and thereafter the cutter 20 cuts a portion downstream in the conveyance direction of the trailing portion 1*a* (a portion shown by a broken line in FIG. 10C). Thereafter, as shown in FIGS. 9C and 9D, the trailing portion 1*a* is discharged in the direction indicated by the arrow J reversely to the supply direction of the sheet 1.

These first and second operations may be selectively performed according to the length of a portion of the sheet 1 on which an image has been already printed. In a case where the first sheet sensor 6 detects the end of the sheet 1 during the printing operation, the discharging operation in which the trailing portion la is discharged in the direction indicated by the arrow J without cutting and the discharging operation in which the trailing portion 1*a* is discharged in the direction indicated by the arrow J after cutting can be selectively performed. In the former case, a discharge time for the trailing portion la can be shortened; in contrast, in the latter case, it is possible to suppress the generation of clogging of a too long trailing portion 1*a* inside of the printing apparatus 100.

In the printing apparatus 100 in the present embodiment, at a downstream side of the conveyance roller 14 in the conveyance direction of the sheet 1, a discharge roller for discharging the sheet 1 from the discharge port, not shown, is not provided. Therefore, in a case where the sheet 1 is cut in a length smaller than the distance between the cutter 20 and the discharge port, the resultant short cut portion is generally discharged through the discharge port in the following manner. Specifically, the tip of the sheet 1 positioned upstream of the short cut portion of the sheet 1 in the conveyance direction is moved in the conveyance direction and the direction reverse thereto, and thus, the tip pushes the short cut portion of the sheet 1 through the discharge port. In the present embodiment, in a case where the first sheet sensor 6 detects the end of the sheet 1 during the pushing operation for the short cut portion of the sheet 1, the trailing portion 1*a* can be discharged in the direction indicated by the arrow J reversely to the supply direction of the sheet 1, as described above.

Figure 11:
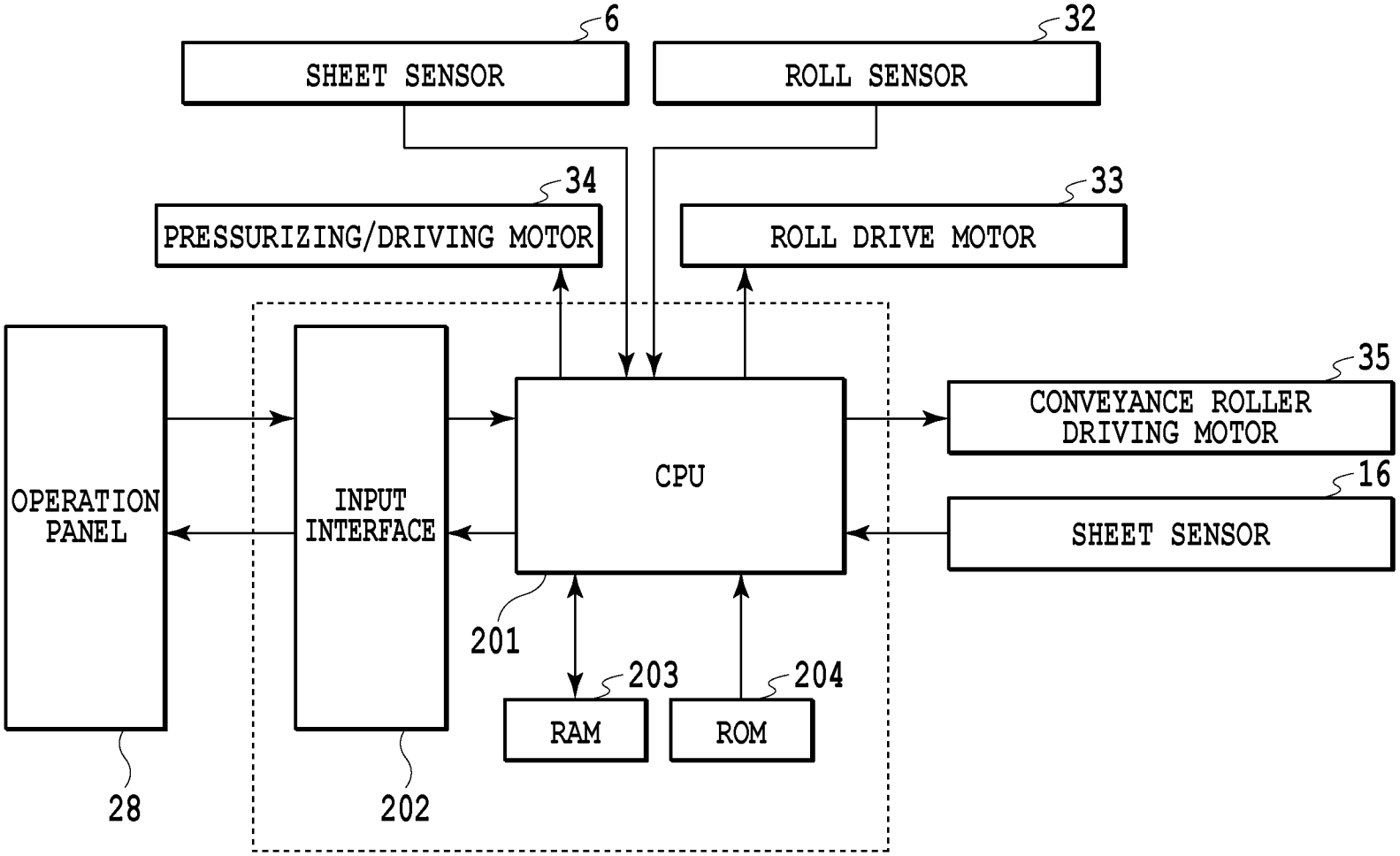
FIG. 11 is a block diagram illustrating a control system of the printing apparatus.

FIG. 11 is a block diagram illustrating a constitutional example of a control system in the printing apparatus 100. A CPU 201 controls each part of the printing apparatus 100 including the supplying apparatus 200, the sheet conveying unit 300, and the print unit 400 in accordance with a control program stored in a ROM 204. The CPU 201 receives the type and width of sheet 1 and various setting information from the operation panel 28 via an input interface 202. Moreover, the CPU 201 writes and reads information about the sheet 1 in and from a RAM 203. A roll driving motor 33 is adapted to rotate the sheet roll R forward and reversely, and configures a drive mechanism (i.e., a rotary mechanism) capable of rotating the sheet roll R. A pressurizing/driving motor 34 is designed to rotate the rotary cam 3*a* for adjusting the pressing force against the arm member 4. A conveyance roller driving motor 35 is adapted to rotate the conveyance roller 14 forward and reversely.

In a case where the sheet roll R set at the supply apparatus 200 is detected by the roll sensor 32, after the tip of the sheet 1 is detected by the first sheet sensor 6, the CPU 201 receives set completion information. Consequently, the CPU 201 issues a rotation command for the pressurizing/driving motor 34, to thus rotate it, thereby adjusting the pressing force against the arm member 4. Thereafter, the CPU 201 allows the roll driving motor 33 to rotate the sheet roll R forward in the direction indicated by the arrow C1, thus feeding the sheet 1. After that, the CPU 201 allows the conveyance roller driving motor 35 to rotate the conveyance roller 14 forward in the direction indicated by the arrow D1 in a case where the second sheet sensor 16 detects the tip of the sheet 1, thus conveying the sheet 1.

Furthermore, the CPU 201 executes the discharging operation of the trailing portion 1*a* of the sheet 1, as described above. Specifically, the CPU 201 allows the pressurizing/driving motor 34 to turn the arm member 4 in the direction indicated by the arrow A2 so as to temporarily separate the first and second driven rollers 8 and 9 from the paper core of the sheet roll R in a case where the first sheet sensor 6 detects the end of the sheet 1. Thereafter, the CPU 201 allows the conveyance roller driving motor 35 to reversely rotate the conveyance roller in the direction indicated by the arrow D2, thereby conveying the trailing portion 1*a* in the direction reverse to the conveyance direction. In a case where the downstream portion of the trailing portion 1*a* in the conveyance direction is conveyed in the direction reverse to the conveyance direction by a distance slightly longer than the distance L2 from the position of the first sheet sensor 6, the CPU 201 allows the pressurizing/driving motor 34 to turn the arm member 4 in the direction indicated by the arrow A1. Consequently, the first and second driven rollers 8 and 9 are brought into press-contact with the paper core of the sheet roll R, thereby nipping the trailing portion 1*a* therebetween. And then, the CPU 201 allows the conveyance roller driving motor 35 to reversely rotate the conveyance roller 14 in the direction indicated by the arrow D2, and further, the roll driving motor 33 to reversely rotate the paper core in the direction indicated by the arrow C2 together with the spool member 2. Hence, the trailing portion 1*a* is discharged in the direction indicated by the arrow J reversely to the supply direction of the sheet 1.

(Second Embodiment)

In the first embodiment, the supplying apparatus 200 is brought into the nip releasing state during the correction of skewing of the sheet 1 and the printing operation of an image on the sheet 1. In the present embodiment, a supplying apparatus 200 is brought into the nip releasing state also in a case where the sheet 1 cannot be automatically supplied. For example, in a case where the sheet 1 is of a type having a high conveyance resistance caused by strong curl due to a high rigidity, it is difficult to automatically supply the sheet 1, unlike the first embodiment.

Figure 12:
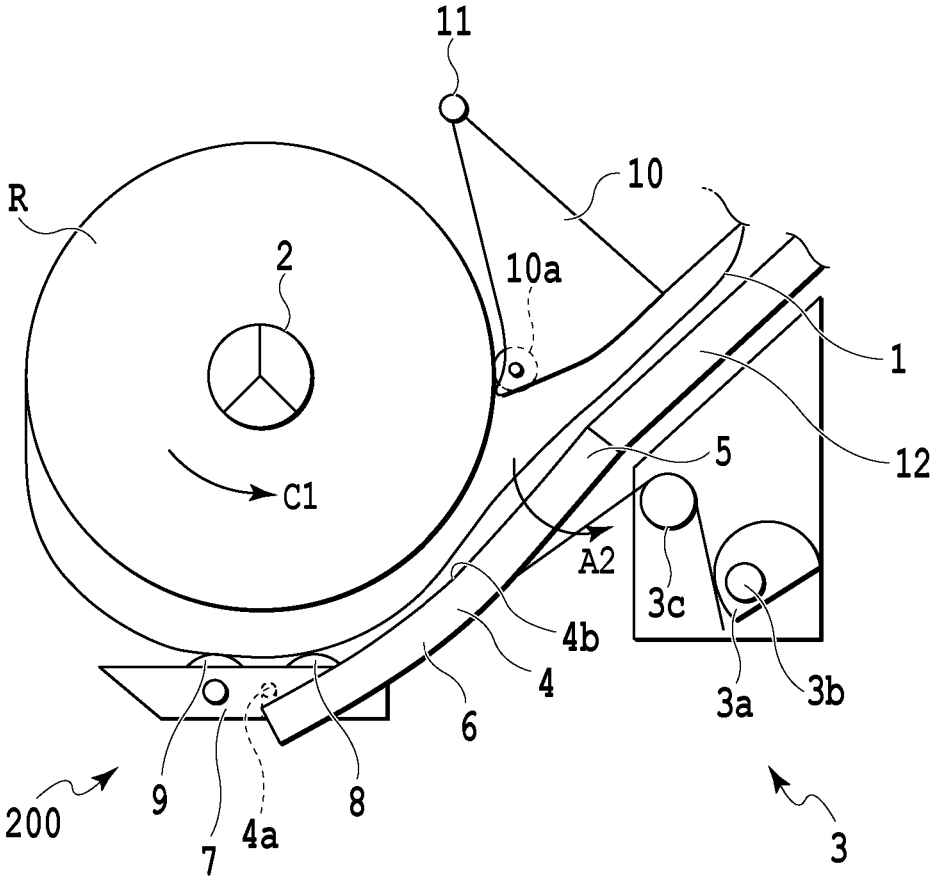
FIG. 12 is a view illustrating a sheet supplying apparatus in a second embodiment of the present invention.

In the present embodiment, first, as shown in FIG. 12, the supplying apparatus 200 is brought into the nip releasing state, and then, the driven rollers 8 and 9 are separated from the sheet roll R. And then, a user inserts the tip of the sheet 1 into a path guide formed on the arm member 4. Thereafter, the user puts his/her hand into a clearance defined between the supplying apparatus 200 and the sheet roll R or into the supplying apparatus 200, and rotates the sheet roll R in the direction indicated by the arrow C1, so as to feed the tip of the sheet 1 up to the conveyance roller 14. In this manner, the supply of the sheet 1 is completed. Thus, the number of types of usable sheets 1 is remarkably increased, so that the supplying apparatus 200 can cope with more types of sheets 1.

(Third Embodiment)

The first embodiment is configured such that the pressing force of the arm member 4 can be switched on three stages: the strong nip state, the weak nip state, and the releasing state in the supplying apparatus 200. The adjustment stages of the pressing force are not limited to three, and further, the pressing force may be adjusted on a continuously variable stage. In this case, the pressing force in the strong nip state is optimally set according to a conveyance resistance that depends upon the shape of a conveyance path of the sheet 1, the rigidity of the sheet 1, and the friction coefficient of the surface of the sheet 1. In setting the sheet roll R, the supplying apparatus 200 is brought into the weak nip state, as described above, and the lock mechanism for locking the spool shaft 21 in such a manner as not to float from the spool holder 31 is brought into an unlocked state. Therefore, the pressing force in the weak nip state is optimally set in such a manner as not to allow the spool shaft 21 to float even in the state in which only the paper core of the sheet roll R is set to the spool shaft 21.

For example, in the case of sheets that are capable of being pressed by a high pressing force while being supplied, such as a highly rigid sheet like a coated paper and a sheet having a high weighing capacity typified by canvas, the pressing force in the strong nip state is highly set. In this manner, the sheet is strongly conveyed, and thus, the sheet can be securely supplied. Specifically, the pressing force in the strong nip state is more highly set with respect to the sheet 1 that is hardly supplied, so that more types of sheets 1 can be automaticallysupplied. Alternatively, the sheet 1 that is hardly automatically supplied can be manually supplied, like in the second embodiment.

(Fourth Embodiment)

Figure 13:
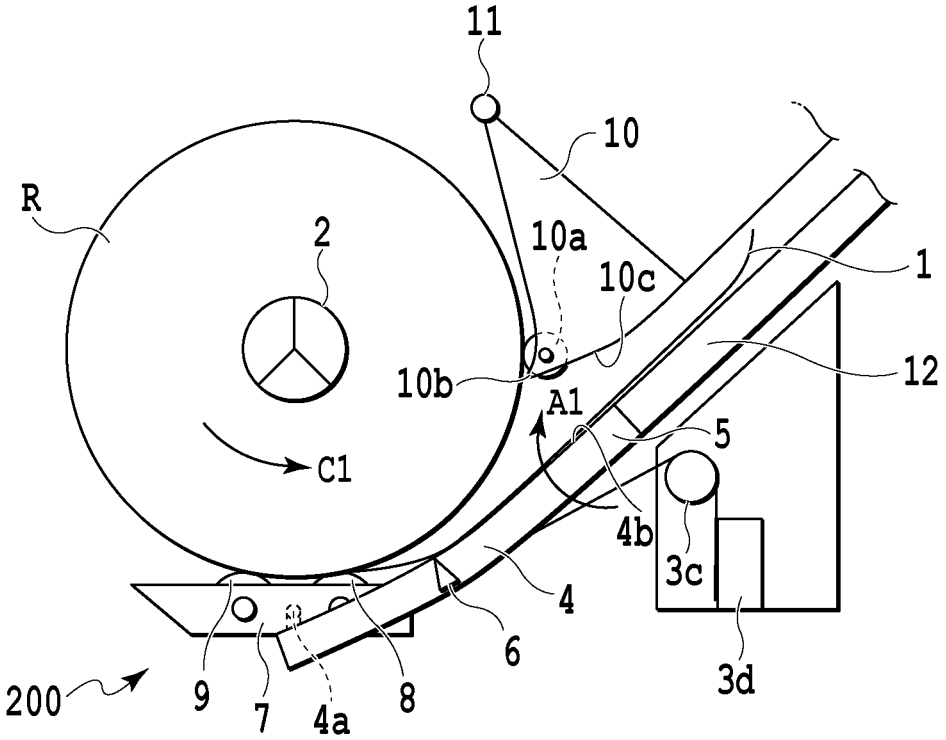
FIG. 13 is a view illustrating a sheet supplying apparatus in a fourth embodiment of the present invention.

A supplying apparatus 200 in the present embodiment is not provided with the rotary cam 3*a* at the drive unit 3 in the above-described embodiments, as shown in FIG. 13. However, the drive unit 3 includes the torsion coil spring 3*c* and a fixing portion 3*d* for fixing one end of the torsion coil spring 3*c*. As a consequence, the arm member 4 is pressed by a constant pressing force in the direction indicated by the arrow A1. The spring constant of the torsion coil spring 3*c* is optimally set so as to suppress a large change in pressing force of the arm member 4 caused by a change in outer diameter of the sheet roll R.

The type of sheet to be used may be limited according to a model of printing apparatus. Plain paper is mainly used in a CAD machine, for example. Since the plain paper has a low rigidity, its conveyance resistance is not so high. Therefore, even in the case of a configuration in which the pressing force of the arm member 4 is constant and a nip pressure cannot be changed, the plain paper can be supplied. In this manner, according to the type of sheet to be used in the printing apparatus, the configuration for changing the pressing force of the arm member 4 is omitted, thus simplifying the configuration of the supplying apparatus 200 and the printing apparatus 100 so as to reduce costs.

(Fifth Embodiment)

Figure 14:
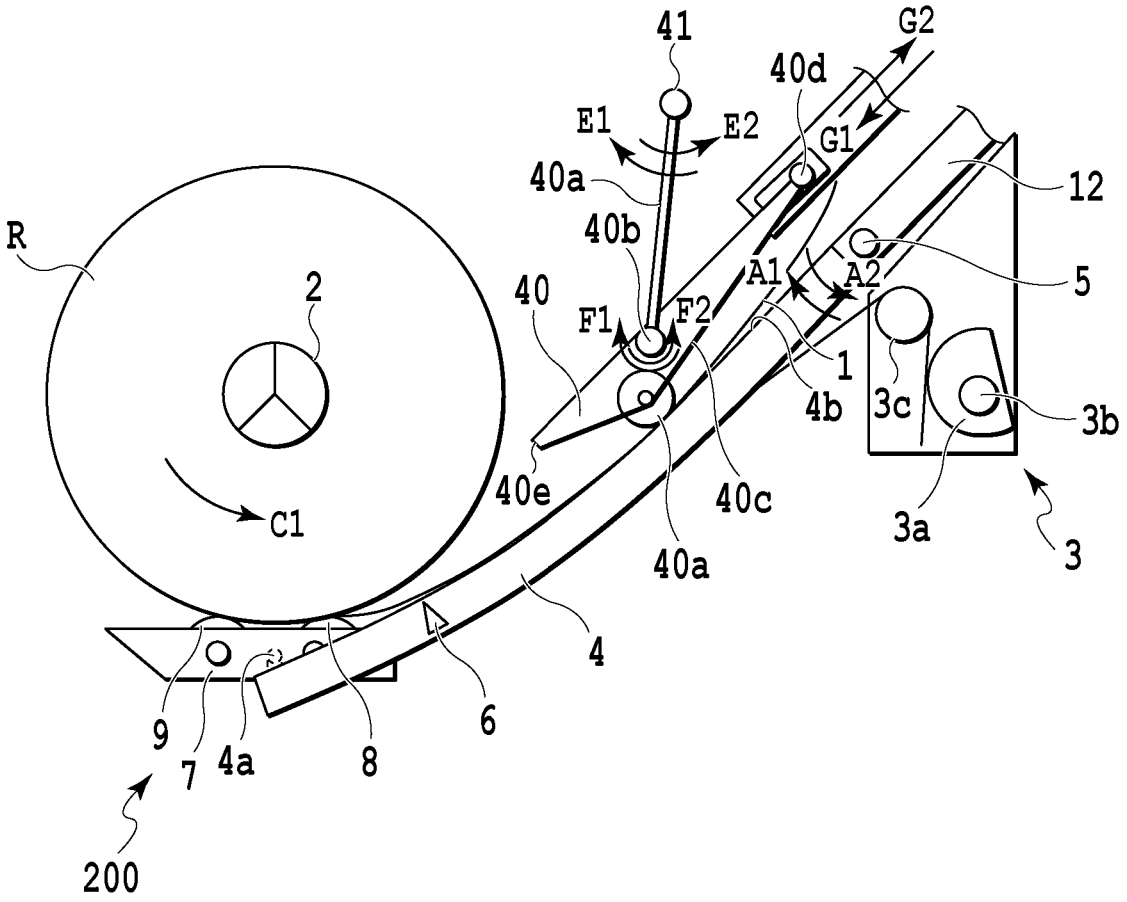
FIG. 14 is a view illustrating a sheet supplying apparatus in a fifth embodiment of the present invention in the case of a large outer diameter of a roll.
Figure 15:
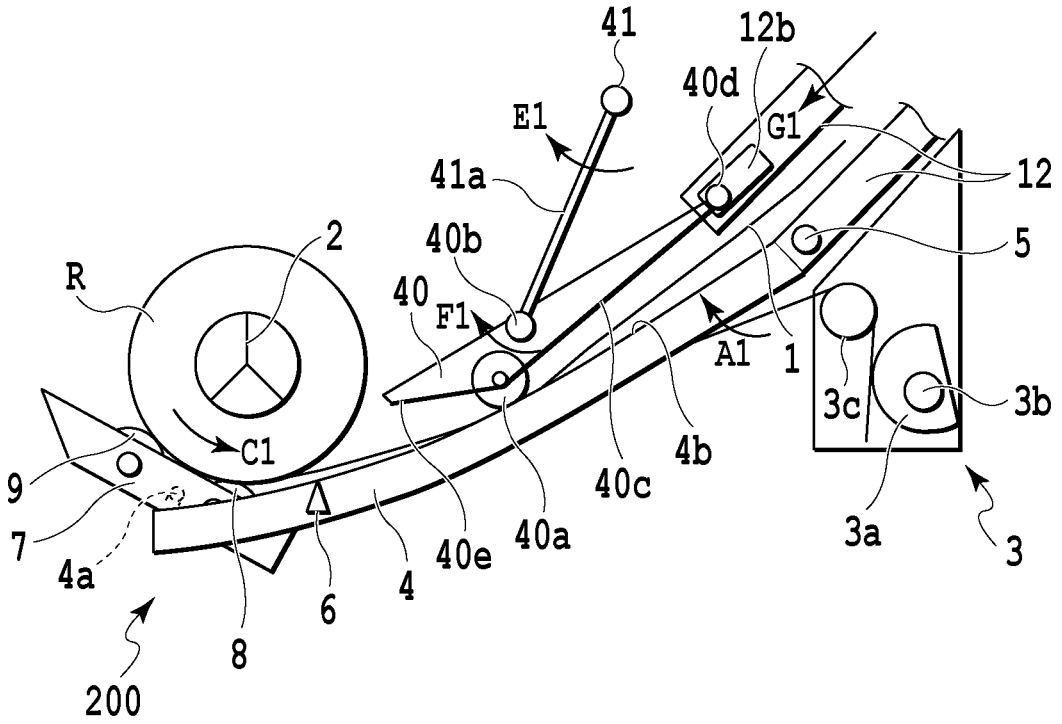
FIG. 15 is a view illustrating the sheet supplying apparatus in the fifth embodiment of the present invention in the case of a small outer diameter of a roll.

FIGS. 14 and 15 are views illustrating a fifth embodiment of the present invention.

A support arm 41*a* is supported on a rotary shaft 41 at a constant position in the supplying apparatus 200 in a manner turnable in directions indicated by arrows E1 and E2. A separating flapper 40 is supported on a flapper shaft 40*b* disposed at the support arm 41*a* in a manner swingable in directions indicated by arrows F1 and F2. The separating flapper 40 is pressed on the guide 4*b* of the arm member 4 in a movable manner by its own weight or a spring having a low load, not shown, via a slide member (i.e., a rotatable roller) 40*a*. The separating flapper 40 is provided with a restricting member 40*d* that is slidable in directions indicated by arrows G1 and G2 along a slot 12*b* formed at the conveyance guide 12. The restricting member 40*d* restricts the swing range of the separating flapper 40 on the flapper shaft 40*b* in the directions indicated by the arrows F1 and F2. In other words, in a case where the arm member 4 is located at one turn position in directions indicated by arrows A1 and A2, the posture of the separating flapper 40 located on the arm member 4 is restricted to one. Consequently, a supply path having a predetermined vertical width in FIGS. 14 and 15 can be formed between the guide 4*b* on the arm member 4 and a guide surface 40*c* of the separating flapper 40.

During the supplying operation of the sheet 1, the sheet 1 intrudes between the guide 4*b* of the arm member 4 and the slide member 40*a*. Therefore, the sheet 1 pushes up the separating flapper 40 by its thickness while being supplied through the supply path defined between the guide 4*b* of the arm member 4 and the guide surface 41*c* of the separating flapper 40. The supply path is formed in a predetermined width, as described above, thereby suppressing any buckling of the sheet such as a low rigidity sheet or a thin sheet.

The arm member 4 is pressed by the torsion coil spring 3*c* all the time in the direction indicated by the arrow A1. Consequently, as the outer diameter of the sheet roll R is reduced, as shown in FIG. 15, the arm member 4 is turned in the direction indicated by the arrow A1 according to the roll outer diameter. Moreover, the posture of the separating flapper 40 is changed in association with the arm member 4, so that the supply path having a predetermined width is defined between the guide surface 41*c* of the separating flapper 40 and the guide 4*b* of the arm member 4. As a consequence, it is possible to suppress any buckling of the sheet such as a low rigidity sheet or a thin sheet, like in the case of the large outer diameter of the sheet roll R, as shown in FIG. 14.

In a case where there is a large clearance between the sheet roll R and a tip end 40*e* of the separating flapper 40, in the case of, particularly, a sheet 1 having a large curl, the tip end of the sheet 1 is wound around the sheet roll R, whereby the sheet 1 possibly hardly intrudes into a sheet supply port between the arm member 4 and the separating flapper 40. In view of this, the small clearance between the sheet roll R and the tip end 40*e* of the separating flapper 40 is desired. In the present embodiment, as the outer diameter of the sheet roll R becomes smaller, the tip end 40*e* of the separating flapper 40 approaches the center of the sheet roll R according to the turn of the support arm 41*a*, the swing of the separating flapper 40, and the movement of the restricting member 40*d*, as shown in FIG. 15. Thus, irrespective of the size of the outer diameter of the sheet roll R, the clearance defined between the sheet roll R and the tip end 40*e* of the separating flapper 40 can be kept to be small, and further, the tip of the sheet 1 can be securely separated from the sheet roll R, to be thus introduced into the sheet supply port.

(Sixth Embodiment)

Figure 16:
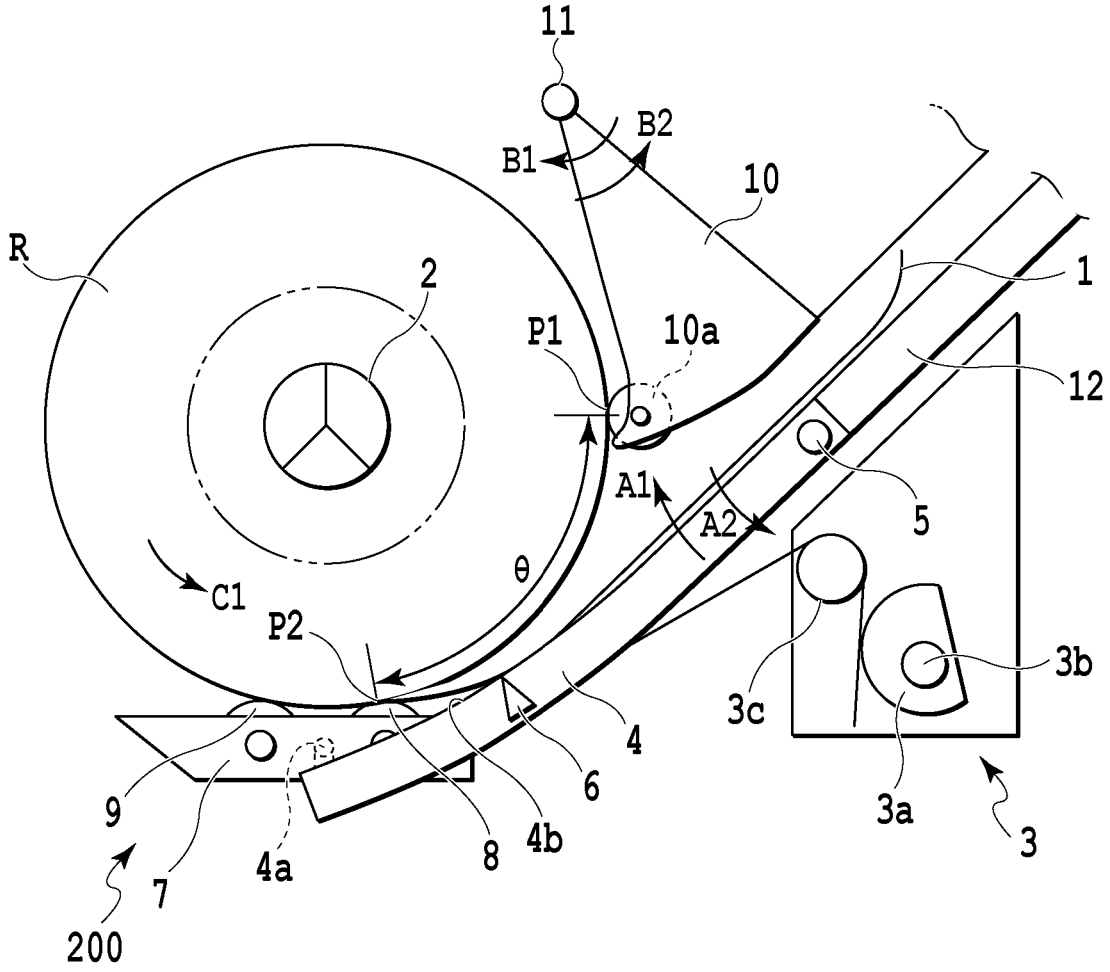
FIG. 16 is a view illustrating a sheet supplying apparatus in a sixth embodiment of the present invention in the case of a large outer diameter of a roll.
Figure 17:
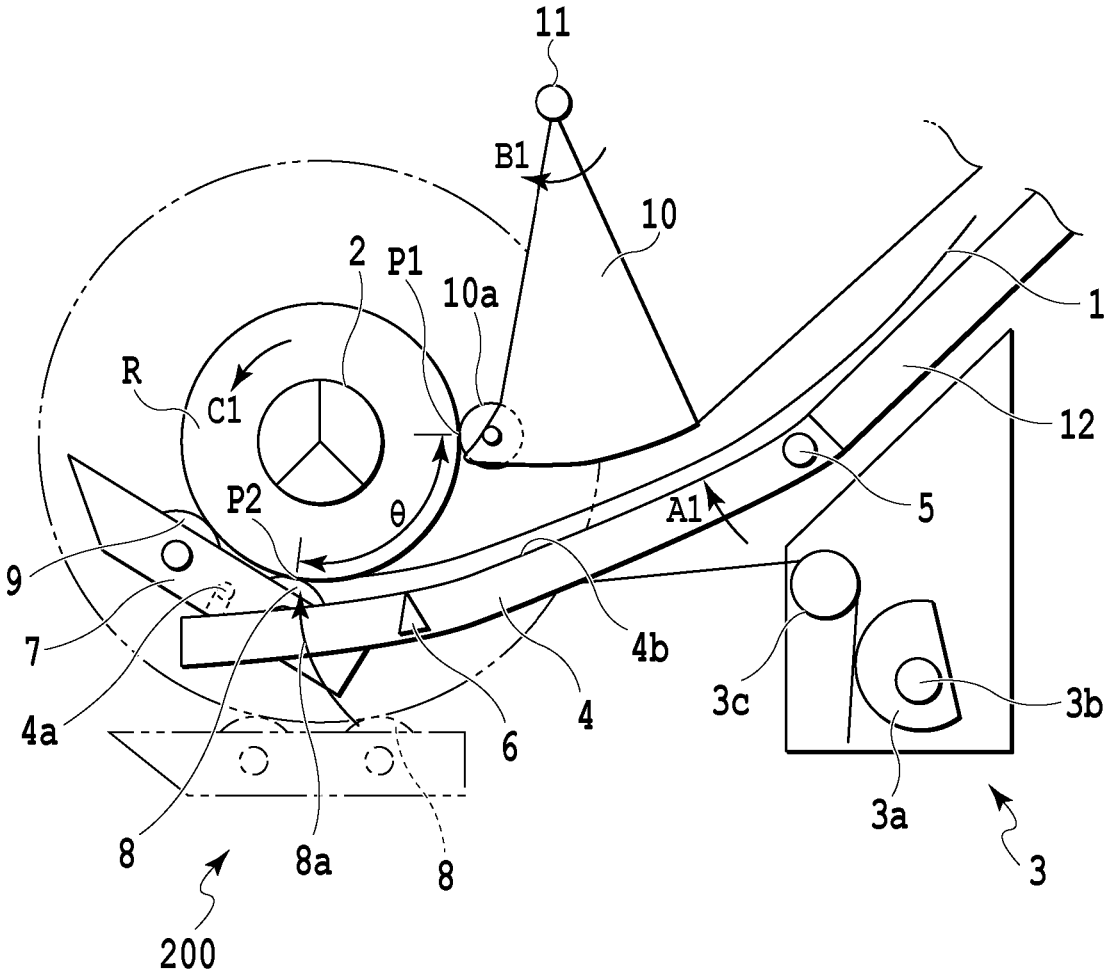
FIG. 17 is a view illustrating the sheet supplying apparatus in the sixth embodiment of the present invention in the case of a small outer diameter of a roll.

FIGS. 16 and 17 are views illustrating a sixth embodiment of the present invention.

The present embodiment is configured such that as the outer diameter of the sheet roll R changes from a large diameter shown in FIG. 16 to a small diameter shown in FIG. 17, the driven roller 8 moves while drawing a trace indicated by an arrow 8*a* in FIG. 17. In the state shown in FIG. 16, the driven roller 8 is located nearer the sheet supply port between the arm member 4 and the separating flapper 10 than a position vertically under the center of the sheet roll R. In this state, a contact position (i.e., a contact point) P1 of the driven roller 10*a* with respect to the sheet roll R and a contact position (i.e., a contact point) P2 of the driven roller 8 with respect to the sheet roll R are separated from each other by an angle θ in the rotational direction of the sheet roll R. In the state shown in FIG. 17, the driven roller 8 is located nearer the position vertically under the center of the sheet roll R than the sheet supply port. In other words, the driven roller 8 moves while drawing the trace indicated by the arrow 8*a* in such a manner as to increase the angle θ.

The curl of the sheet 1 becomes stronger as the outer diameter of the sheet roll R becomes smaller. However, the driven roller 8 moves as the outer diameter becomes smaller, and then, the supply direction of the sheet 1 along a tangent at the point P2 changes downward and rightward in FIG. 17. Therefore, the tip of the sheet 1 is easily separated from the sheet roll R. Furthermore, a distance between a position at which the sheet 1 is drawn out of the sheet roll R and a position at which the sheet 1 is brought into contact with the guide 4*b* of the arm member 4 becomes short, thus reducing an aerial conveyance range, at which the sheet 1 is not guided but conveyed. Consequently, it is possible to suppress any occurrence of buckling of a sheet having a low rigidity as well.

(Seventh Embodiment)

Figure 18:
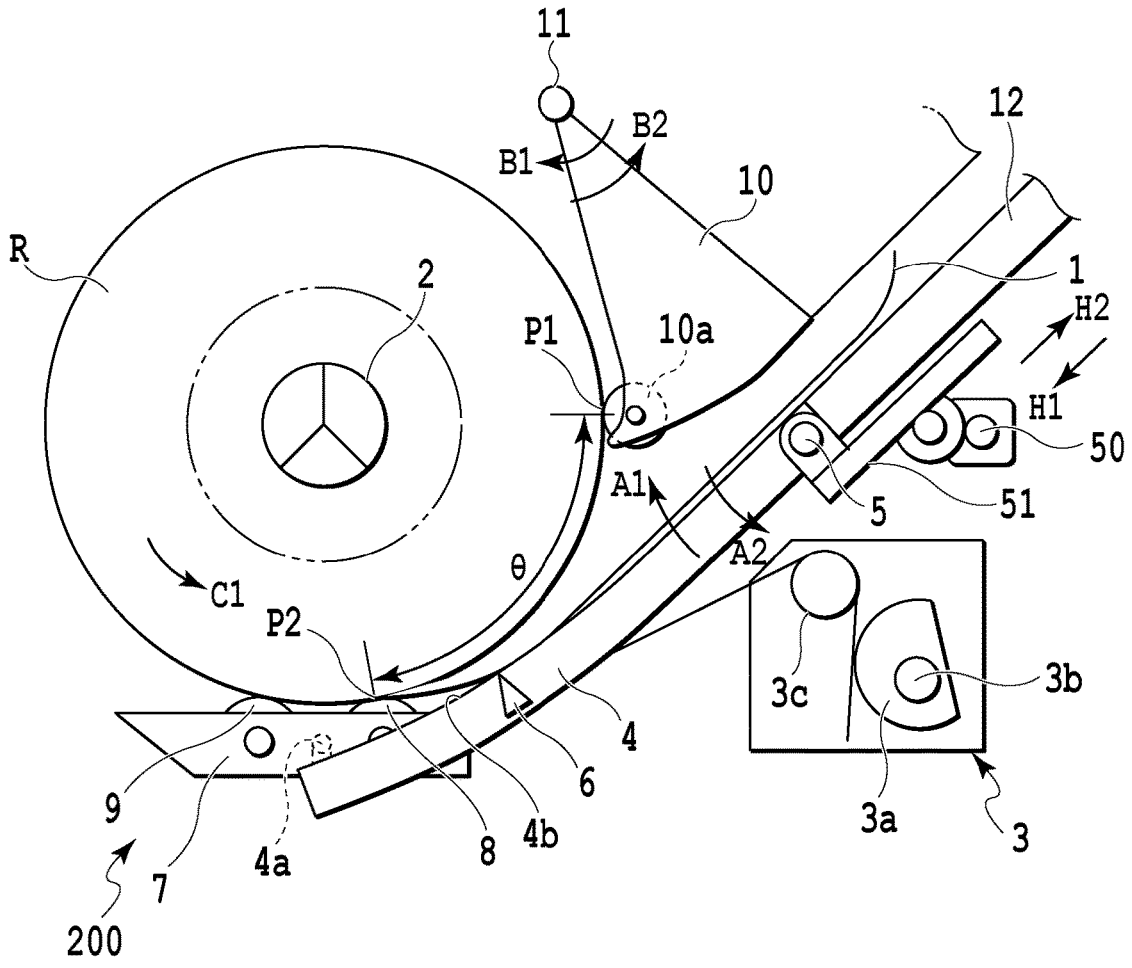
FIG. 18 is a view illustrating a sheet supplying apparatus in a seventh embodiment of the present invention in the case of a large outer diameter of a roll.
Figure 19:
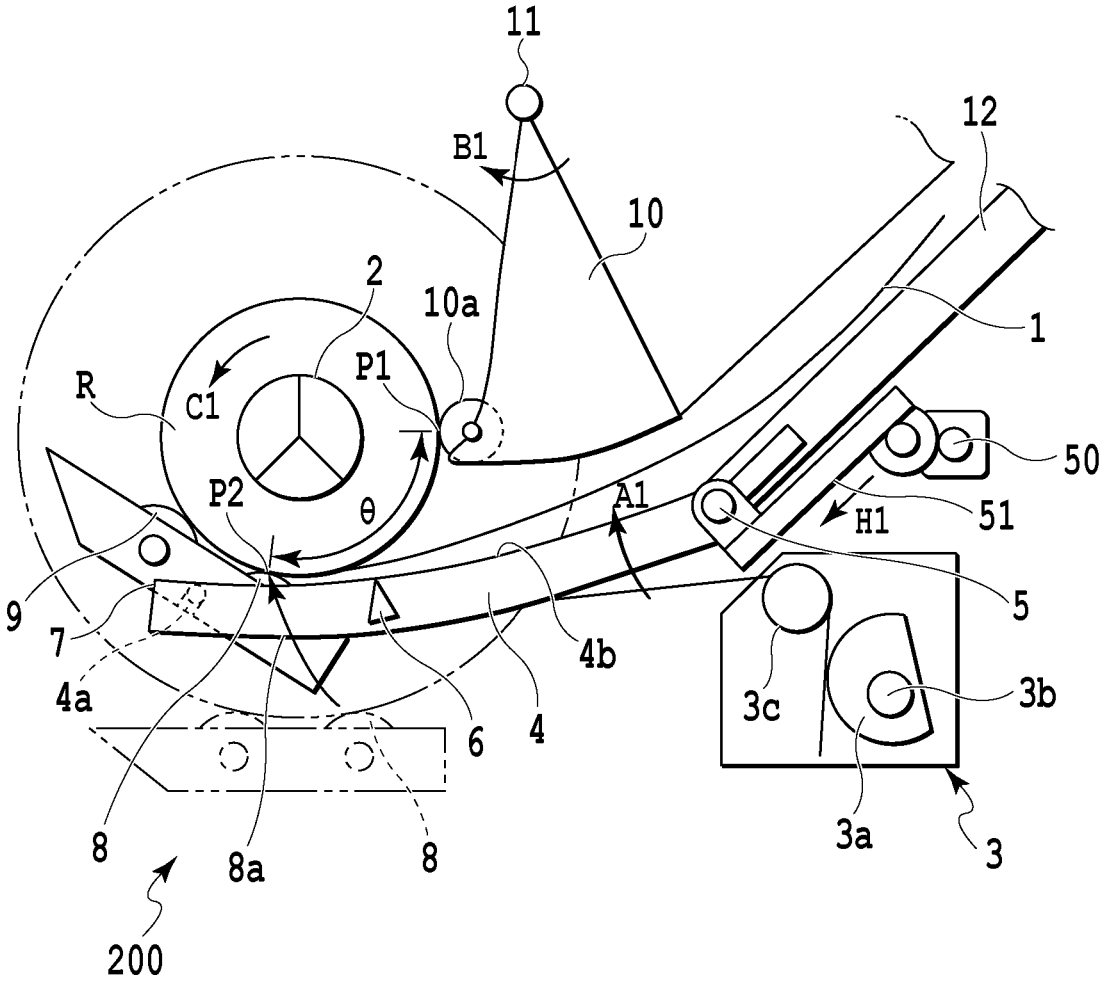
FIG. 19 is a view illustrating the sheet supplying apparatus in the seventh embodiment of the present invention in the case of a small outer diameter of a roll.

FIGS. 18 and 19 are views illustrating a seventh embodiment of the present invention. In the present embodiment, the supplying apparatus 200 in the sixth embodiment is additionally provided with a guide 51 for movably guiding the rotary shaft 5 of the arm member 4 in directions indicated by arrows H1 and H2 parallel to the conveyance direction of the sheet 1 and a drive unit 50 for moving the rotary shaft 5 in the directions indicated by the arrows H1 and H2. The drive unit 50 constitutes an adjusting mechanism capable of adjusting the position of the arm member 4 in such a manner as to shift the contact point P2 in the circumferential direction of the sheet roll R.

The drive unit 50 moves the rotary shaft 5 in the direction indicated by the arrow H1 reverse to the supply direction of the sheet 1 as the outer diameter of the sheet roll R becomes smaller. In this manner, as the roll outer diameter becomes smaller, the contact point P2 is shifted upstream in the supply direction along the circumference of the sheet roll R. Therefore, the supply direction of the sheet 1 along the tangent at the contact point P2 changes to be oriented downward and rightward in FIG. 19 farther than in the sixth embodiment. As a consequence, the tip of the sheet 1 is more easily separated from the sheet roll R. Moreover, the distance between the position at which the sheet 1 is drawn out of the sheet roll R and the position at which the sheet 1 is brought into contact with the guide 4*b* of the arm member 4 becomes shorter than that in the sixth embodiment. Thus, it is possible to reduce the aerial conveyance range, in which the sheet 1 is not guided but conveyed, thereby suppressing any occurrence of buckling of a sheet having a low rigidity. The drive unit 50 can adjust the position of the arm member 4 according to the type of sheet 1.

(Other Embodiments)

In the above-described embodiments, the center portion of the sheet roll R is the core (i.e., the paper core), around which the sheet 1 is wound. The driven rollers 8 and 9 are brought into press-contact with the core of the sheet roll via the trailing portion 1*a* of the sheet 1 while holding the sheet therebetween, so that the trailing portion 1*a* is discharged by utilizing the rotation of the core of the sheet roll R. However, the driven rollers 8 and 9 may be brought into press-contact with the spool member 2 via the trailing portion 1*a*. For example, in a case where the sheet roll R has no core, the trailing portion 1*a* can be discharged by utilizing the rotation of the spool member 2 after the trailing portion 1*a* is drawn out of the sheet roll R.

Moreover, in the above-described embodiments, the first sheet sensor 6 for detecting the end of the trailing portion 1*a* of the sheet 1 downstream in the conveyance direction is used to detect that the trailing portion 1*a* is drawn out of the sheet roll R. However, the method for detecting that the trailing portion 1*a* is drawn out is not limited to the use of the first sheet sensor 6. For example, a sensor for detecting a length of the sheet 1 drawn out of the sheet roll R or a change in rotational torque of the sheet roll R or the conveyance roller 14 may be used for performing the discharging operation for the trailing portion 1*a* based on the result detected by the sensor.

The printing apparatus is not limited to only the configuration provided with the two sheet supplying apparatuses corresponding to the two sheet rolls, but it may be provided with a single sheet supplying apparatus or three or more sheet supplying apparatuses. Moreover, the printing apparatus is simply required to print an image on the sheet supplied by the sheet supplying apparatus, and therefore, it is not limited to only the ink jet printing apparatus. Furthermore, the print system and configuration of a printing apparatus are arbitrary. For example, the printing apparatus may be either of a serial scan system, in which printing/scanning by a print head and a sheet conveying operation are repeated so as to print an image, or of a full line system, in which a sheet is sequentially conveyed to a position facing an elongated print head so as to print an image.

The present invention is applicable to various kinds of sheet supplying apparatuses in addition to a sheet supplying apparatus for supplying a sheet serving as a print medium to a printing apparatus. For example, the present invention is applicable to an apparatus for supplying a sheet to be read to a reader such as a scanner or a copying machine, an apparatus for supplying sheet-like workpiece to a machining device such as a cutter, and the like. The above-described sheet supplying apparatuses may be configured independently of the printing apparatus, the reader, the machining device, and the like, and further, may be provided with a control unit (i.e., a CPU) for the sheet supplying apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234761 filed Nov. 19, 2014, which is hereby incorporated by reference herein in its entirety.

What is claimed is:

1. A printing apparatus comprising:

a holding unit configured to hold a sheet roll in which a continuous sheet is wound around a center portion;

a driving unit configured to drive the sheet roll held by the holding unit in a forward direction and a reverse direction;

a pressing unit configured to be movable between a press-contact position in which the pressing unit is brought into press-contact with an outer periphery of the sheet roll and a separation position in which the pressing unit is separated from the outer periphery of the sheet roll, the pressing unit being movable according to an outer diameter of the sheet roll so as to be brought into press-contact with the outer periphery of the sheet roll when in the press-contact position;

a conveyance roller configured to convey the sheet supplied from the holding unit by rotating the sheet roll in the forward direction;

a driving motor configured to drive the conveyance roller in a first direction and a second direction opposite to the first direction;

a print unit configured to print an image on the sheet conveyed by the conveyance roller driven in the first direction;

a detecting unit configured to detect an end of the sheet supplied from the holding unit; and a control unit configured to, in a case where the detecting unit detects the end of the sheet, drive the conveyance roller by the driving motor in the second direction in a state where the pressing unit is moved to the separation position, and subsequently drive the sheet roll by the driving unit in the reverse direction in a state where the sheet is held between the center portion and the pressing unit by moving the pressing unit to the press-contact position.

2. The printing apparatus according to claim 1, wherein the center portion is a core of the sheet roll, around which the sheet is wound.

3. The printing apparatus according to claim 1, wherein the center portion is a spool member inserted into a hollow hole of the sheet roll.

4. The printing apparatus according to claim 1, wherein the pressing unit is brought into press-contact with the outer periphery of the sheet roll from below with respect to a gravity direction.

5. The printing apparatus according to claim 1, wherein the pressing unit is a roller.

6. The printing apparatus according to claim 1, wherein the pressing unit is provided on a moving member that is movable according to an outer diameter of the sheet roll, and the moving member includes a lower guide that guides the sheet to be conveyed by driving the conveyance roller in the second direction.

7. The printing apparatus according to claim 6, wherein the detecting unit is provided on the moving member.

8. The printing apparatus according to claim 6, further comprising an upper guide located above the lower guide, wherein the upper guide and lower guide form a discharge path between the upper guide and lower guide, the sheet to be conveyed by driving the conveyance roller in the second direction passing through the discharge path.

9. The printing apparatus according to claim 8, wherein the upper guide is movable according to an outer diameter of the sheet roll so as to be brought into press-contact with the outer periphery of the sheet roll.

10. The printing apparatus according to claim 1, further comprising a cutter configured to cut the sheet.

11. The printing apparatus according to claim 10, wherein the cutter cuts the sheet to be conveyed by driving the conveyance roller in the second direction.

12. The printing apparatus according to claim 1, wherein the detecting unit is arranged between the holding unit and the conveyance roller.

* * * * *